US006018958A

United States Patent [19]

Lingelbach et al.

[11] Patent Number: 6,018,958

[45] Date of Patent: Feb. 1, 2000

[54] DRY SUCTION INDUSTRIAL AMMONIA REFRIGERATION SYSTEM

[76] Inventors: Fredric J. Lingelbach; John F. Lingelbach, both of P.O. Box 609, Elkhorn, Nebr. 68022

[21] Appl. No.: 09/009,428

[22] Filed: Jan. 20, 1998

[51] Int. Cl.[7] ..... F25B 41/04

[52] U.S. Cl. ..... 62/222; 62/119; 62/503

[58] Field of Search ..... 62/503, 119, 222

[56] References Cited

U.S. PATENT DOCUMENTS

| | | | |
|---|---|---|---|
| 2,693,683 | 11/1954 | Toothman | 62/117.55 |
| 3,214,932 | 11/1965 | Grant | 62/174 |
| 3,315,484 | 4/1967 | Ross | 62/174 |
| 3,370,440 | 2/1968 | Kellie | 62/503 |
| 3,636,723 | 1/1972 | Kramer | 62/197 |
| 3,786,651 | 1/1974 | Eschbaugh et al. | 62/222 |
| 3,817,046 | 6/1974 | Aoki et al. | 62/40 |
| 3,866,427 | 2/1975 | Rothmayer et al. | 62/7 |
| 3,919,859 | 11/1975 | Ross | 62/503 |
| 3,986,362 | 10/1976 | Baciu | 60/641 |
| 4,858,681 | 8/1989 | Sulzberger | 165/70 |
| 4,878,355 | 11/1989 | Beckey et al. | 62/115 |
| 5,171,592 | 12/1992 | Holtzapple et al. | 426/69 |
| 5,189,885 | 3/1993 | Ni | 62/117 |
| 5,259,210 | 11/1993 | Ohya et al. | 62/212 |
| 5,291,753 | 3/1994 | Rockenfeller et al. | 62/480 |
| 5,355,692 | 10/1994 | Brownfield | 62/212 |
| 5,386,700 | 2/1995 | Hyde | 62/224 |
| 5,396,780 | 3/1995 | Bendsten | 62/212 |
| 5,435,149 | 7/1995 | Strong et al. | 62/218 |
| 5,502,970 | 4/1996 | Rajendran | 62/115 |
| 5,546,757 | 8/1996 | Whipple, III | 62/225 |

*Primary Examiner*—Henry Bennett
*Assistant Examiner*—Marc Norman
*Attorney, Agent, or Firm*—Koley, Jessen, Daubman & Rupiper, P.C.; Mark D. Frederiksen

[57] ABSTRACT

A dry suction refrigeration system includes an evaporator fed with liquid refrigerant which discharges a vapor refrigerant to an accumulator. A compressor receives vapor refrigerant from the accumulator and compressies the vapor refrigerant. A condenser receives the compressed vapor refrigerant from the compressor and transforms the refrigerant into liquid refrigerant. A receiver receives the liquid refrigerant from the condenser and supplies it to the evaporator. The evaporator includes an electronic expansion valve operable to continuously monitor the evaporation of liquid refrigerant in the evaporator and to continuously meter the flow of liquid refrigerant, so as to cause a complete vaporization of the liquid refrigerant. Because the liquid refrigerant is completely evaporated, the vapor refrigerant is moved through the system by pressure differential alone.

14 Claims, 22 Drawing Sheets

DRY SUCTION INDUSTRIAL AMMONIA REFRIGERATION SYSTEM

TECHNICAL FIELD

The present invention relates generally to commercial refrigeration systems, and more particularly to an improved dry suction ammonia refrigeration system.

BACKGROUND OF THE INVENTION

A major drawback of industrial and commercial refrigeration systems which utilize ammonia as a refrigerant is the high cost of installation, operation, and maintenance. The main reason for these high costs lies in the fact that conventional ammonia refrigeration systems are designed for relatively high discharge pressures, and require the use of liquid pumps and large accumulators, because the processing, cooler, or product freezer units do not completely vaporize the liquid ammonia into gas. Thus, liquid ammonia will flow through the system in combination with ammonia gas. This incomplete vaporization of the ammonia is the main cause for the high cost of installation, operation, and maintenance of ammonia type refrigeration systems currently on the market.

Because liquid ammonia must be moved throughout the system, liquid ammonia pumps or pumper drums must be used to pump the liquid, requiring higher pressures throughout the system. In addition, pumping liquid throughout the system requires larger accumulators and larger pipes throughout the system, thereby adding to the installation costs as well as operating costs.

SUMMARY OF THE INVENTION

It is therefore a general object of the present invention to provide an improved ammonia refrigeration system which completely evaporates the ammonia liquid in the evaporator to form a dry suction gas and thereby form a dry suction refrigeration system.

A further object of the present invention is to provide an improved ammonia refrigeration system which eliminates liquid pumps or pumper drums.

A further object of the present invention is to provide an improved ammonia refrigeration system which utilizes accumulators, intercoolers, and piping of a reduced size compared to conventional liquid ammonia refrigeration systems.

Still another object is to provide an improved ammonia refrigeration system which operates at a lower pressure and with less ammonia than conventional ammonia refrigeration systems.

Still a further object of the present invention is to provide an improved ammonia refrigeration system which reduces operating costs, installation costs, and maintenance costs as compared to conventional ammonia refrigeration systems.

These and other objects of the present invention will be apparent to those skilled in the art.

The dry suction refrigeration system of the present invention includes an evaporator fed with liquid refrigerant which discharges a vapor refrigerant to an accumulator. A compressor receives vapor refrigerant from the accumulator and compresses the vapor refrigerant. A condenser receives the compressed vapor refrigerant from the compressor and transforms the refrigerant into liquid refrigerant. A receiver receives the liquid refrigerant from the condenser and supplies it to the evaporator. The evaporator includes an electronic expansion valve operable to continuously monitor the evaporation of liquid refrigerant in the evaporator and to continuously meter the flow of liquid refrigerant, so as to cause a complete vaporization of the liquid refrigerant. Because the liquid refrigerant is completely evaporated, the vapor refrigerant is moved through the system by pressure differential alone.

A dry suction system, by nature, substantially redues the quantity of refrigerant and personnel in the event of a spill or rupture. Furthermore, this type of system requires less electrical energy to operate due to the system design.

DESCRIPTION OF THE PREFERRED EMBODIMENT

Figure 1:
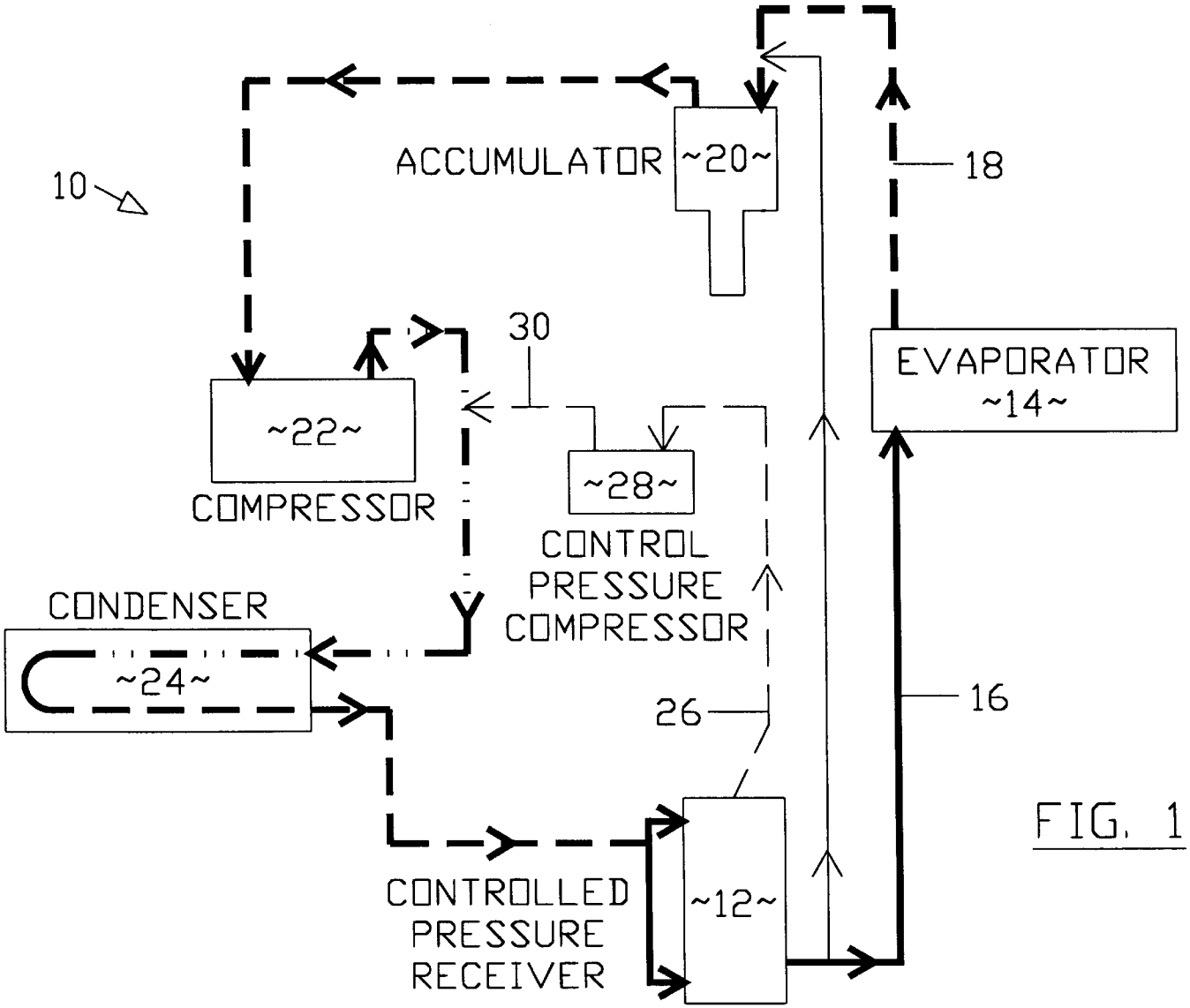
FIG. 1 is a block flow diagram of a single stage refrigeration system of the present invention.

Referring now to the drawings, in which similar or corresponding parts are identified with the same reference numeral and more particularly to FIG. 1, the dry suction refrigeration system of the present invention is designated generally at 10, and a block flow diagram of the system is shown.

Beginning at the controlled pressure receiver 12, liquid refrigerant, preferably ammonia, is pushed to an evaporator 14, wherein the liquid is completely evaporated, to form a dry suction gas. In order to distinguish between the forms of the refrigerant, solid line 16 indicates refrigerant in a liquid form, and dashed line 18 shows refrigerant in a dry suction gas form. The dry suction gas is moved from the evaporator to accumulator 20, where the gas is then drawn by the compressor 22. At the compressor, the refrigerant gas is compressed and pumped to condenser 24. The dry suction gas is condensed at condenser 24 back to a liquid, and flows back to the controlled pressure receiver 12, completing the cycle.

A conduit 26 is taken off the controlled pressure receiver 12 to a dedicated compressor 28. Compressor 28 maintains the pressure in the pressure receiver 12, and is therefore identified as control pressure compressor 28. Discharge from control pressure compressor 28 is returned back to condenser 24 via conduit 30.

Figure 11:
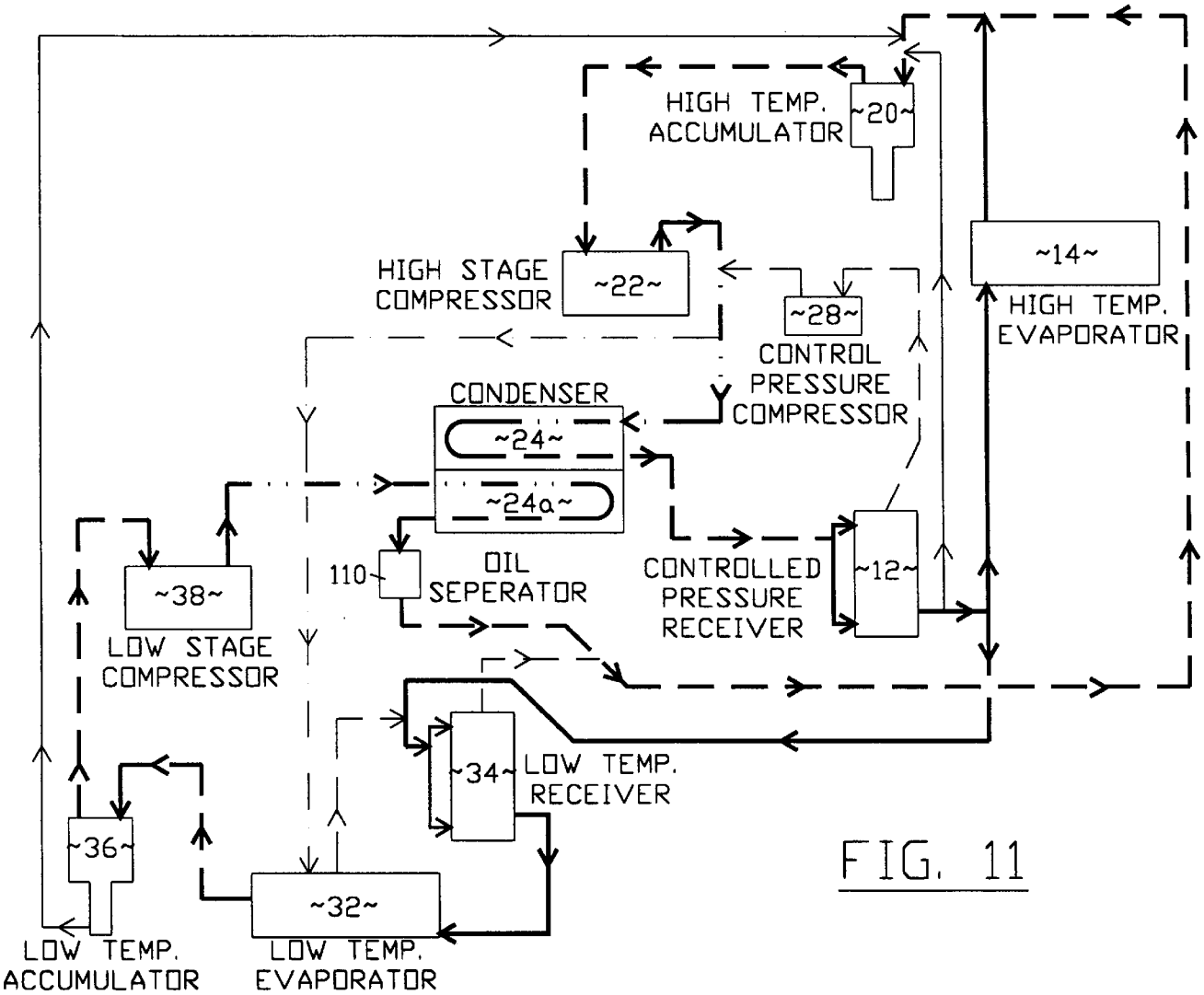
FIG. 11 is a block flow diagram of a two stage refrigeration system.

Referring now to FIG. 11, a two-stage system is shown in a block flow diagram, with a first stage having a higher pressure and higher temperature, and a second stage with a lower pressure and lower temperature. The high stage of FIG. 11 is identical to the single stage version of the invention shown in FIG. 1, and for this reason all components will be identified with the same numerals. Starting once again with the controlled pressure receiver 12, liquid refrigerant is pushed to evaporators 14, wherein the refrigerant is completely evaporated to a dry suction gas. The dry suction gas is moved to the accumulator 20 where it is then drawn in by compressor 22. The refrigerant gas is compressed at compressor 22 and pumped to condenser 24 where the gas is condensed back to a liquid and flows back to the controlled pressure receiver 12. In the two-stage system, a portion of the discharge gas from high stage compressor 22 is piped to the low stage evaporators for defrosting purposes. This gas may also be used to defrost high temperature evaporator units, if so desired.

Liquid refrigerant from the high stage accumulator 20 is pushed through a pipe to the low stage receiver 34 to maintain the liquid level in that vessel. The liquid refrigerant in low stage receiver 34 is pushed to the low temperature evaporator units, where the liquid is completely evaporated to form a dry suction gas. The dry suction gas from evaporators 32 is brought to the low stage accumulator 36 where the gas is then drawn by the low stage compressor 38. The gas is compressed in compressor 38, and pumped to a desuperheating coil 24*a* (if desired) in high stage condenser 24. After desuperheating the gas, the gas is brought back through an optional oil separator 42 to the high stage accumulator 20. Excess liquid in the low stage accumulator 36 is pushed through a pipe to the suction of the high stage accumulator 20 utilizing a transfer system.

Figure 2:
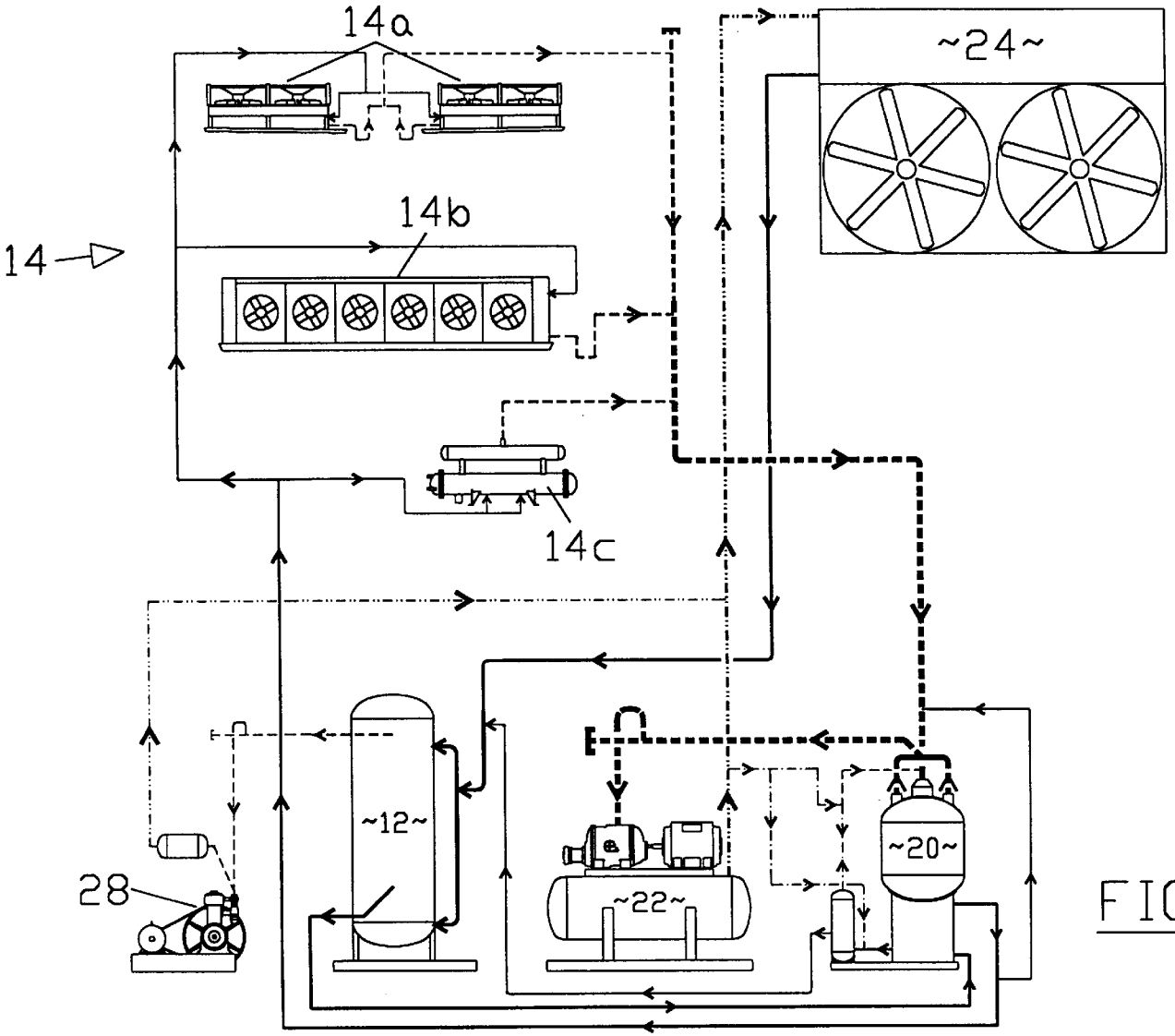
FIG. 2 is a detailed flow diagram of the single stage system of FIG. 1.

FIG. 2 is similar to FIG. 1, but utilizes component designations for the various boxes in the flow diagram of FIG. 1. Thus, liquid refrigerant from controlled pressure receiver 12 is pushed to evaporators designated generally at 14. In FIG. 2, the evaporators include processing units 14*a*, cooler units 14*b*, and a chiller 14*c*. Obviously, other types of uses are encompassed within the scope of this invention, although not detailed in this drawing. At each evaporator unit 14*a*, 14*b*, and 14*c*, the flow of liquid is completely evaporated to form a dry suction gas, which is then returned to the accumulator 20 where it is drawn by a compressor 22 and compressed and forwarded to condenser 24. Once condenser 24 transforms the gas back to a liquid, it is returned to receiver 12 for another cycle.

Figure 3:
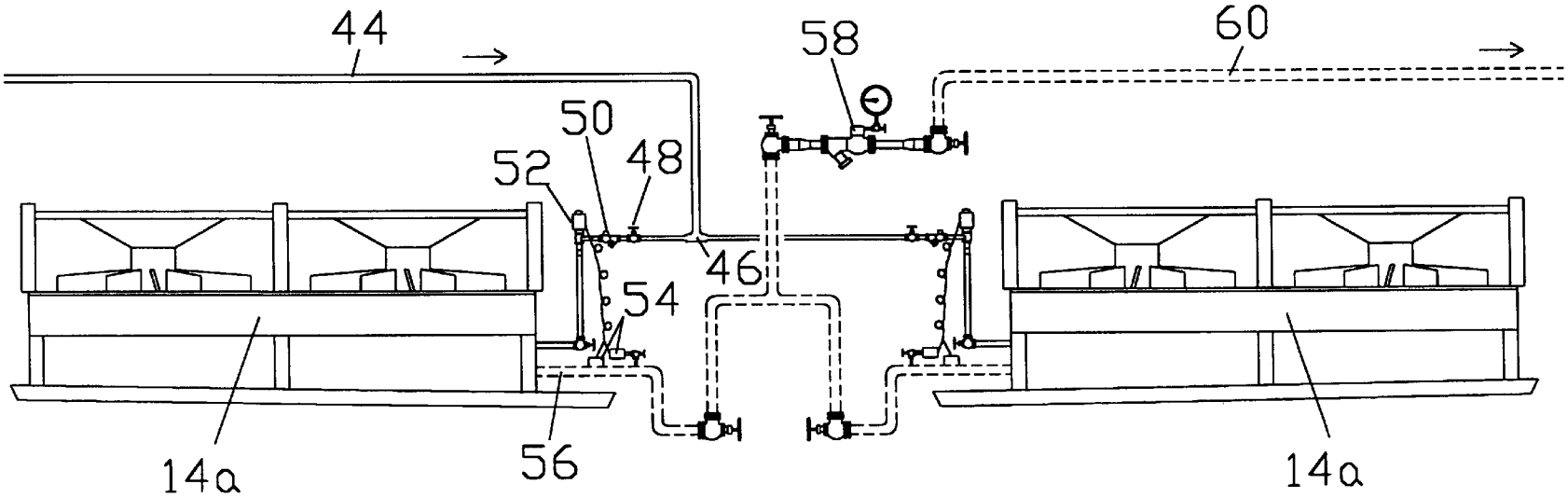
FIG. 3 is an enlarged schematic view of the high temperature processing evaporators of the present invention.

FIG. 3 is a detailed schematic view of a pair of processing units 14*a*. The high temperature liquid ammonia, or other refrigerant, typically having a pressure in the range of 55–60 psi, is directed from pipe 44 to a tee 46 where it is then directed to each individual processing unit 14*a*. The liquid passes through a globe valve 48, a solenoid with strainer 50, and thence through an electronic expansion valve 52 before entering the processing unit 14*a*. Electronic expansion valve 52 includes sensors 54 which detect the discharge gas temperature and pressure through outlet pipe 56 and meters the flow of liquid through expansion valve 52 to the exact proportions needed to do maximum cooling without overfeeding and causing liquid carryover. Dry suction gas from outlet pipe 56 is directed through a dual pressure regulator 58 with a wide open feature and a strainer before continuing through outlet conduit 60 at a pressure of approximately 25–30 psig.

Figure 4:
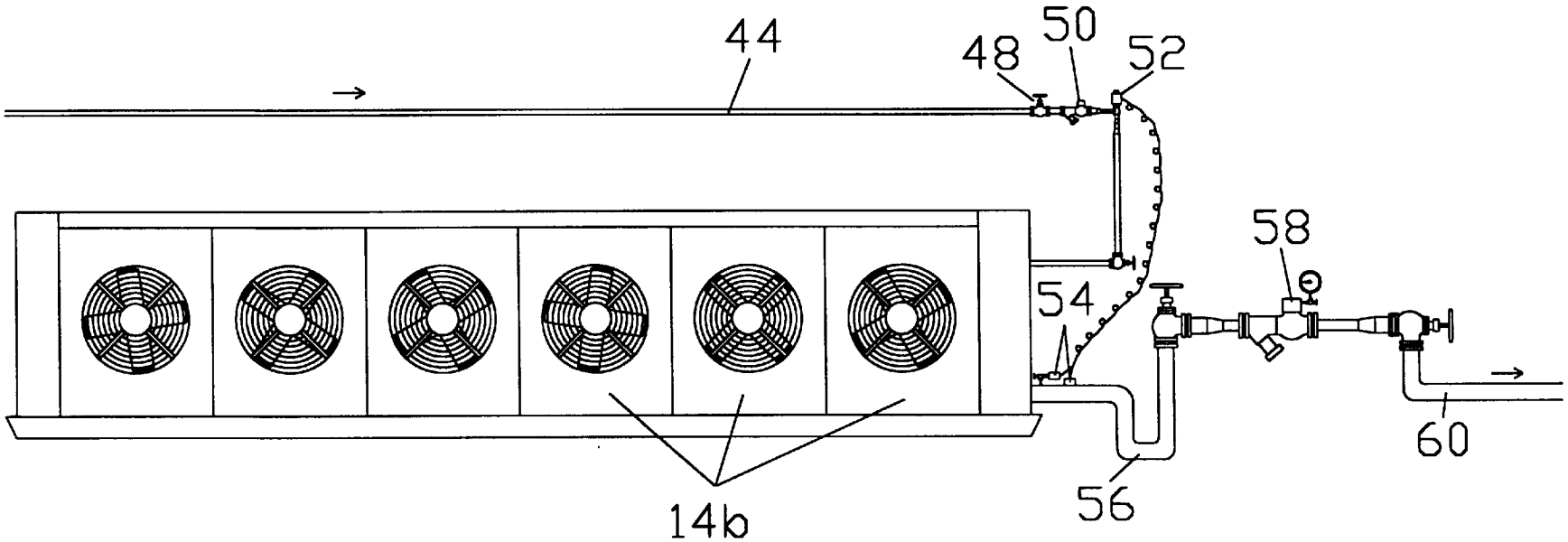
FIG. 4 is an enlarged schematic view of the high temperature cooler evaporators of the present invention.

FIG. 4 shows a similar arrangement, wherein liquid ammonia normally at a pressure of about 55–60 psig is conveyed through pipe 44 through a globe valve 48, solenoid with strainer 50 and electronic expansion valve 52 to the cooler units 14*b*. Sensors 54 on outlet pipe 56 will control electronic expansion valve 52 and meter liquid flow to ensure complete evaporation of the liquid to form a dry suction gas which is conveyed through pressure regulator 58 to outlet conduit 60 at a pressure of approximately 25–30 psig.

Figure 5A:
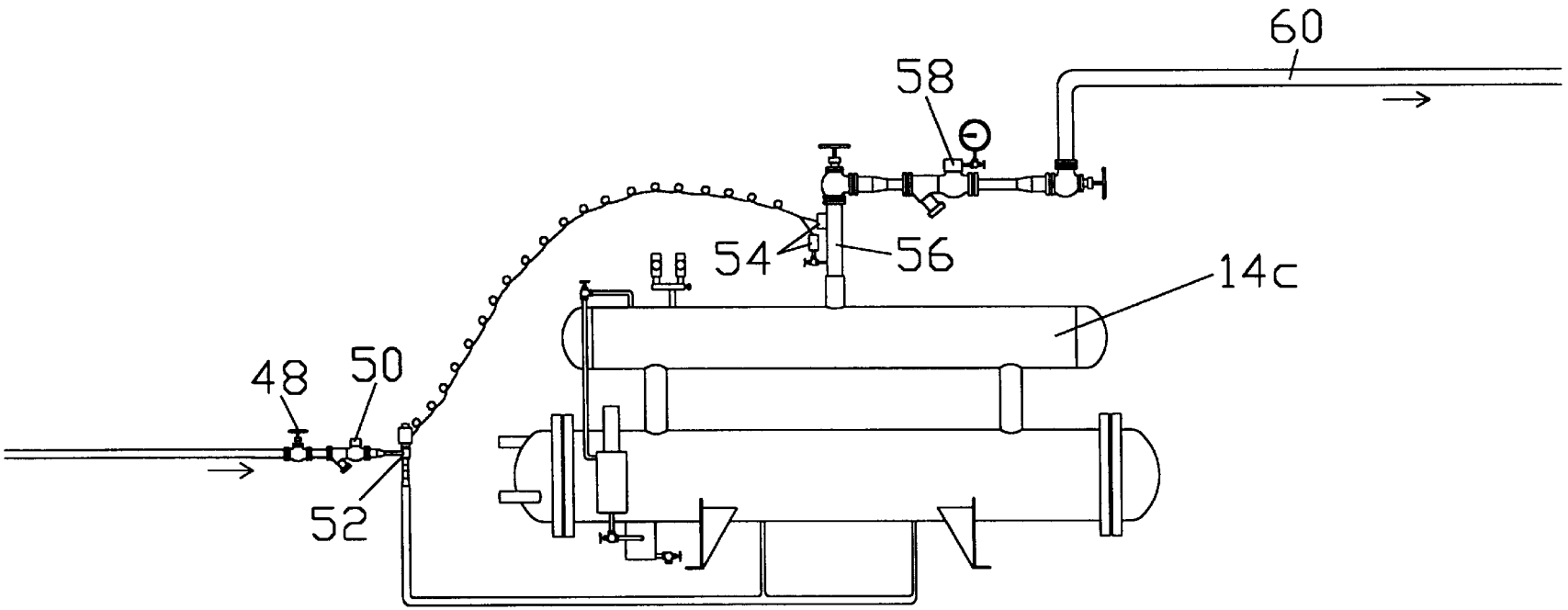
FIG. 5A is an enlarged schematic view of the chiller of the present invention utilizing an electronic expansion valve.

A chiller unit is shown in schematic form in FIG. 5*a*, and utilizes the same arrangement of globe valve 48, solenoid 50 and electronic expansion valve 52 to conduct liquid ammonia to the chiller unit 14*c*. While the chiller 14*c* shown in FIG. 5A is typical, any type of chiller or heat exchanger could be used. The valve arrangements would be typical for all types of chillers or heat exchangers. Dry suction gas formed by the evaporation of the liquid refrigerant leaves chiller 14*c* via outlet pipe 56, runs through a pressure regulator 58 and then is conveyed by outlet conduit 60.

Figure 5B:
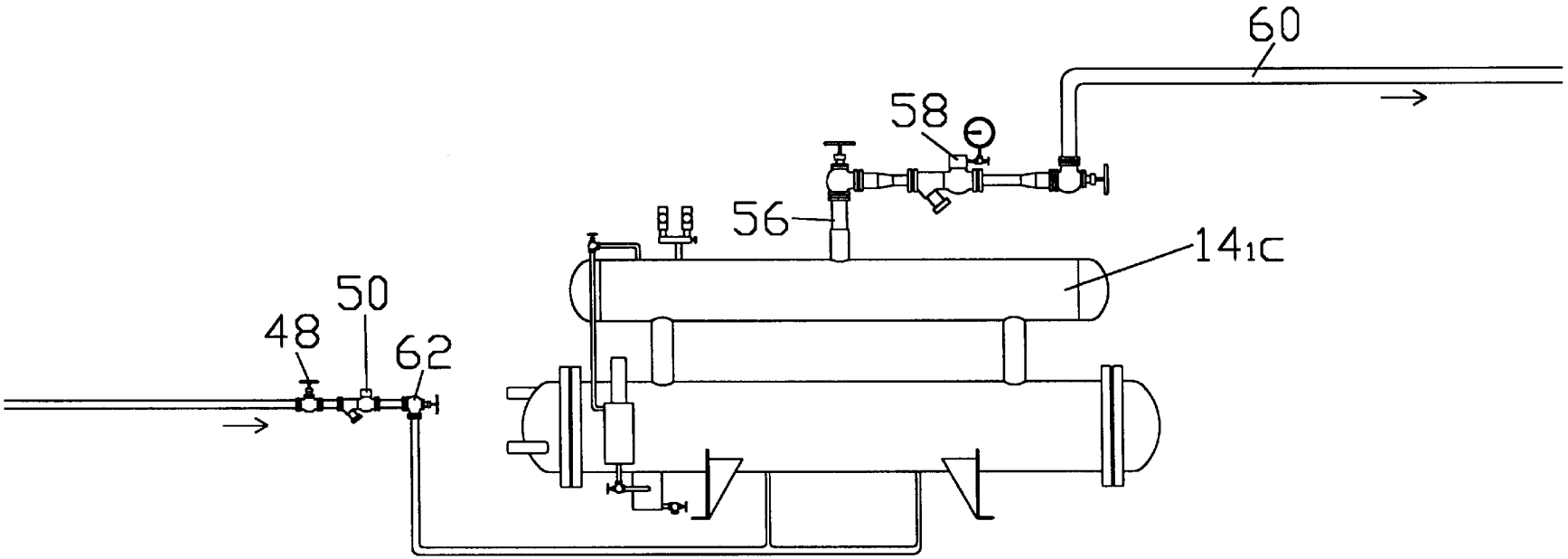
FIG. 5B is a schematic diagram similar to FIG. 5A but using a standard flooded configuration.

FIG. 5B shows a standard flooded ammonia chiller which could be utilized in place of the chiller of FIG. 5A, due to the dry suction nature of the refrigeration system. Chiller 14'*c* receives liquid refrigerant through a globe valve 48, solenoid 50, and thence a hand expansion valve 62 (which is utilized in place of the electronic expansion valve 52 in chiller unit 14*c*). Dry suction gas is vented through outlet pipe 56, pressure regulator 58, and thence outlet conduit 60 in the same fashion as the chiller unit of FIG. 5A.

Figure 6:
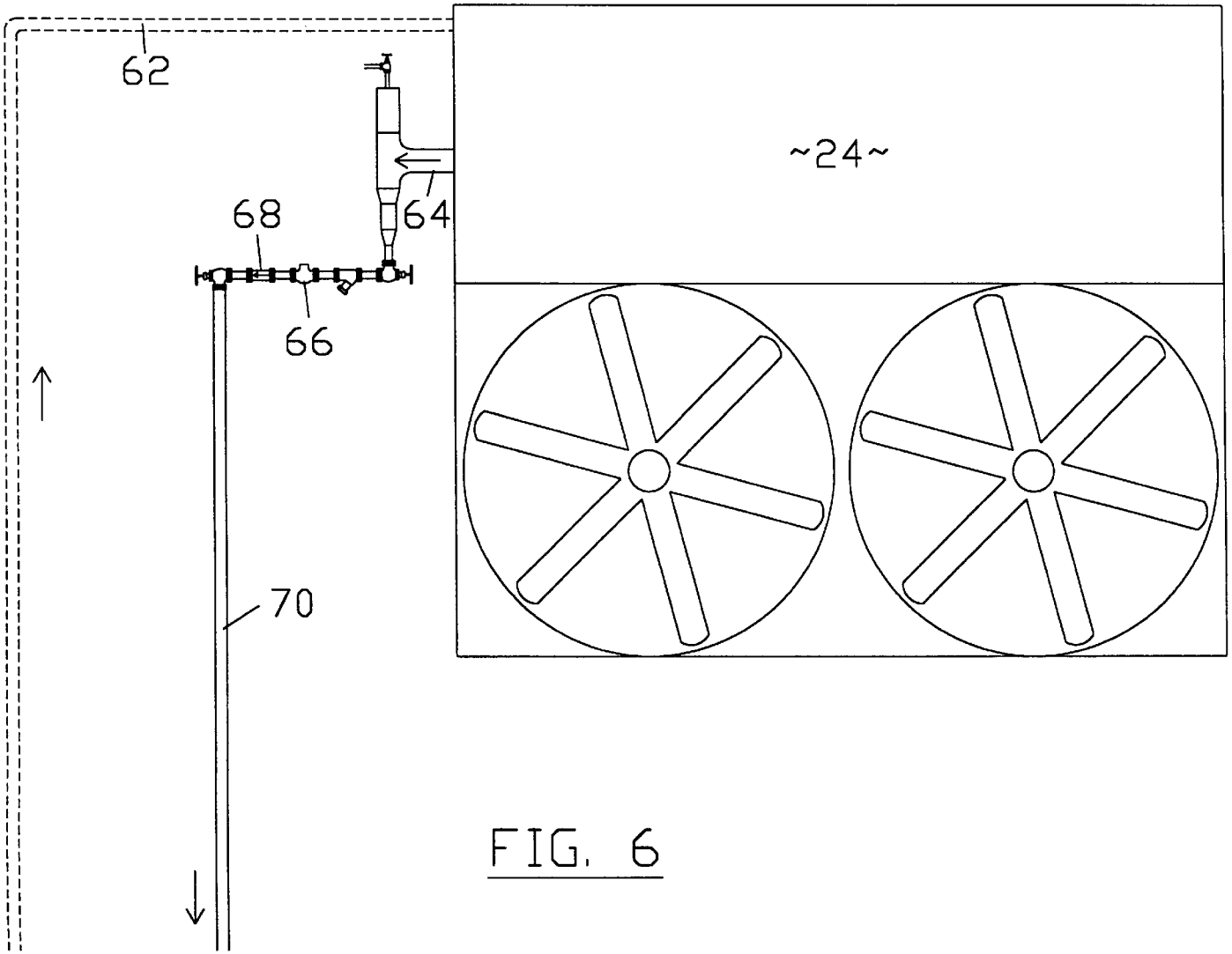
FIG. 6 is an enlarged schematic view of a single stage condenser used in the system of FIG. 2.

The condenser 24 of the refrigeration system 10 of the present invention is shown in enlarged schematic form in FIG. 6. Condenser 24, is of conventional manufacture, but significant changes in the piping are used in the refrigeration system of this invention. Refrigerant in the form of gas having a pressure of approximately 110–185 psi is conveyed from compressor 28 (shown in FIG. 2) via inlet pipe 62, to condenser 24. The outlet pipe 64 is connected to a full size tee, the top of which has a full size extension of approximately 8 to 10 inches which is capped. A purge valve off of the cap is piped to a purger. This feature allows a significant amount of non-condensables to accumulate and be purged. This improvement is necessary to remove non-condensables when condenser outlets are installed with mechanical traps. Once condenser 24 has condensed the ammonia gas to liquid form, it exits the condenser through outlet 64 and thence through a trap 66, a check valve 68, and thence via pipe 70 to the receiver, at a pressure of approximately 55–60 psi. Trap 66 may be a disk trap, a float ball trap, or any equivalent type of trap which will allow only liquid to exit the condenser and to keep a pressure differential across the trap. In conventional systems, "P" traps or equivalents have been used to simply balance the condenser and provide an initial liquid seal to the receiver. The refrigeration system of this invention does away with this arrangement in favor of the mechanical trap.

Traps 66 are mounted on each leg of the condenser, although it may be possible to "gang" the legs into one main header and trap the main header. The upstream side of trap 66 is regulated by the condenser capacity, and the downstream side pressure is regulated by the compressor arrangement which controls the pressure on the controlled pressure receiver 12 (shown in FIG. 2). This pressure differential allows the refrigeration system 10 of the present invention to be run at a very low discharge pressure, thereby benefiting with significant energy savings from the reduced pressure requirement. In addition, the mechanical trap allows for more efficient winter operation, as the pressure differential would discourage liquid from "hanging up" inside the condenser during cold weather. Such a mechanical trap would not be used on conventional systems.

Figure 7:
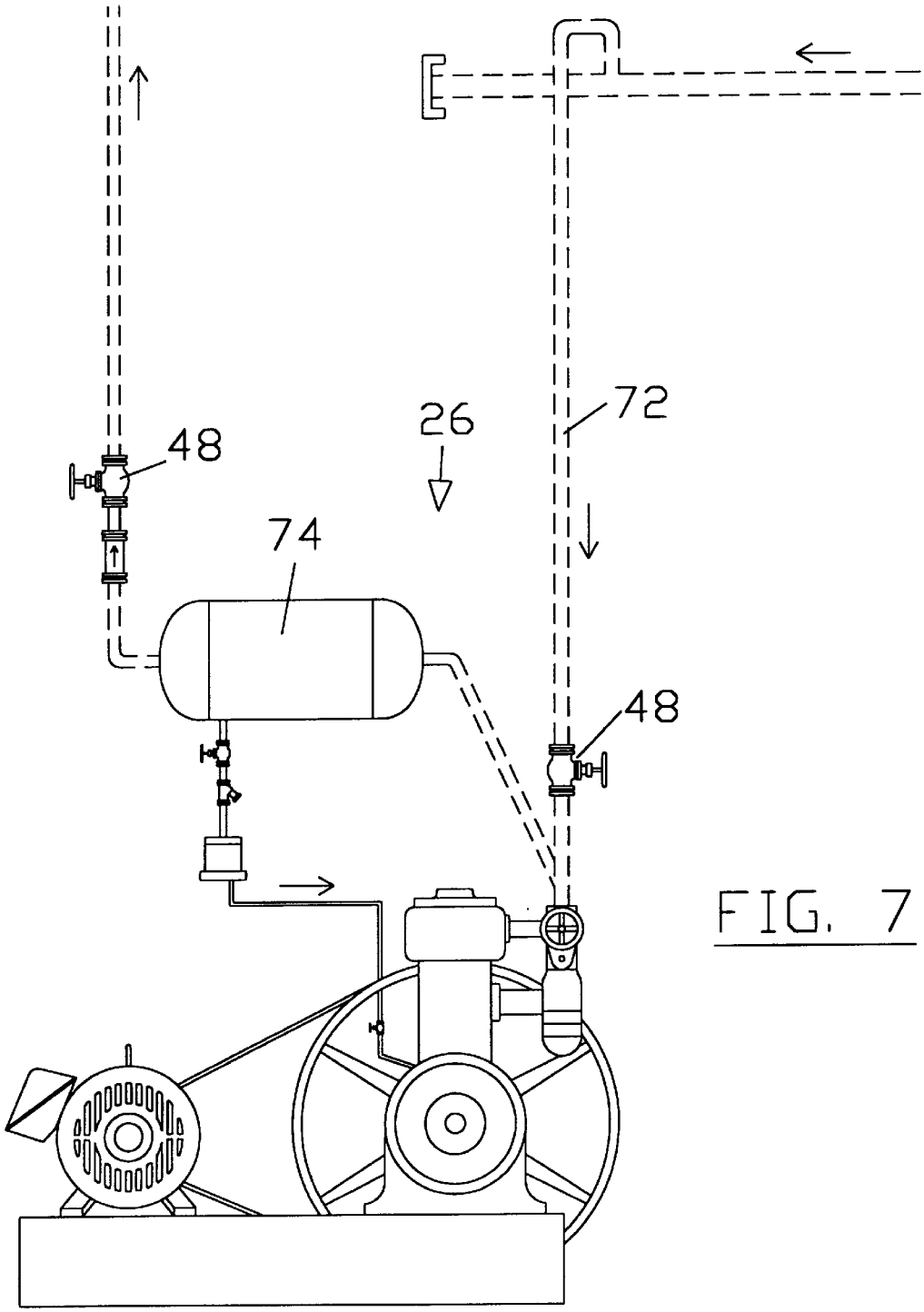
FIG. 7 is an enlarged schematic view of the dedicated compressor used in the system of FIG. 2.

Referring now to FIG. 7, an enlarged schematic view of the dedicated compressor 28, and associated piping, is shown. Compressor 28 receives vapor refrigerant from receiver 12, compresses it, and discharges the compressed vapor refrigerant to the discharge line from compressor 22. Compressor 28 may be of any suitable style, although a 30 horsepower compressor is shown in FIG. 7. Compressor 28 will maintain the proper pressure in the controlled pressure receiver (not shown), typically in the range of 55–60 psi. Compressor 28 is of a standard type with an oil separator 74 and related valves, and increases the discharge pressure of the refrigerant gas to approximately 110-185 psi. Globe valves 48 are installed on either side of compressor 28, in order to facilitate repairs.

Figure 8:
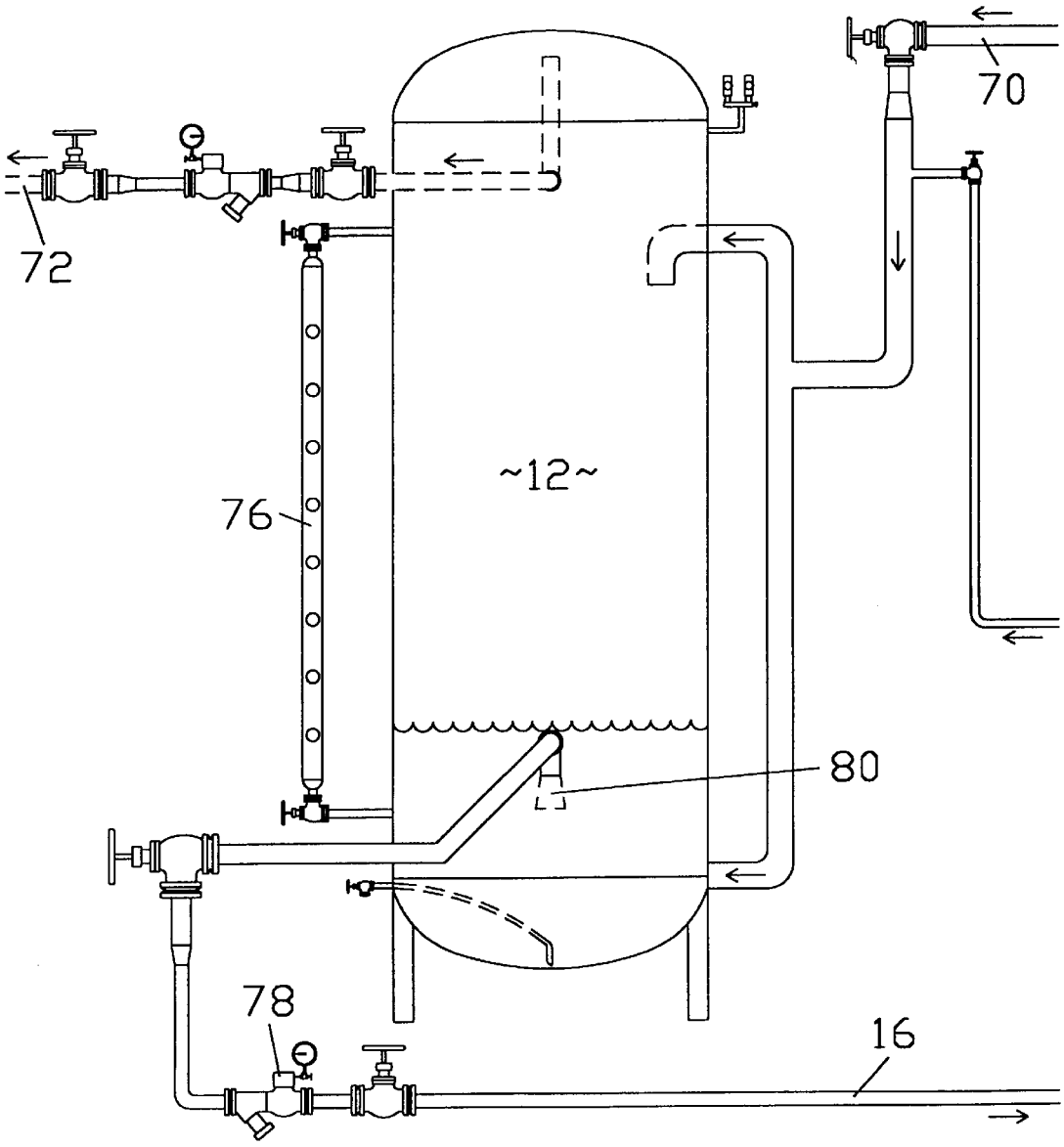
FIG. 8 is an enlarged schematic view of the controlled pressure receiver used in the system of FIG. 2.

An enlarged schematic view of the controlled pressure receiver 12 is shown in more detail in FIG. 8. Receiver 12 utilizes either a line to dedicated compressor 28 (see FIG. 2) or a line to an existing compressor (which may be found on accumulator 20) or both, to control pressure inside receiver 12. Liquid coming from condenser 24 arrives via pipe 70, and will be at the same pressure as receiver 12, once the liquid has passed through trap 66 (shown in FIG. 6). Liquid refrigerant from receiver 12 is pumped by the pressure within receiver 12 to the individual evaporators 14 via line 16. The liquid level within receiver 12 is monitored by a level control device 76, such as an electronic level probe, floats, or other equivalent apparatus. A solenoid operated valve 78 is typically mounted in the main liquid feed line 16 in order to stop the flow of ammonia to the rest of the plant as necessary. Valve 78 may be an electro-mechanical type, or any other type of control valve that can be automatically shut off in the event of a refrigerant leak.

In order to more efficiently move liquid from receiver 12, it is preferred that a reducer 80 be mounted at the inlet end of main liquid feed line 16. This would be mounted with the large size facing downward, and connected to main feed line 16, as shown in FIG. 8.

Figure 9:
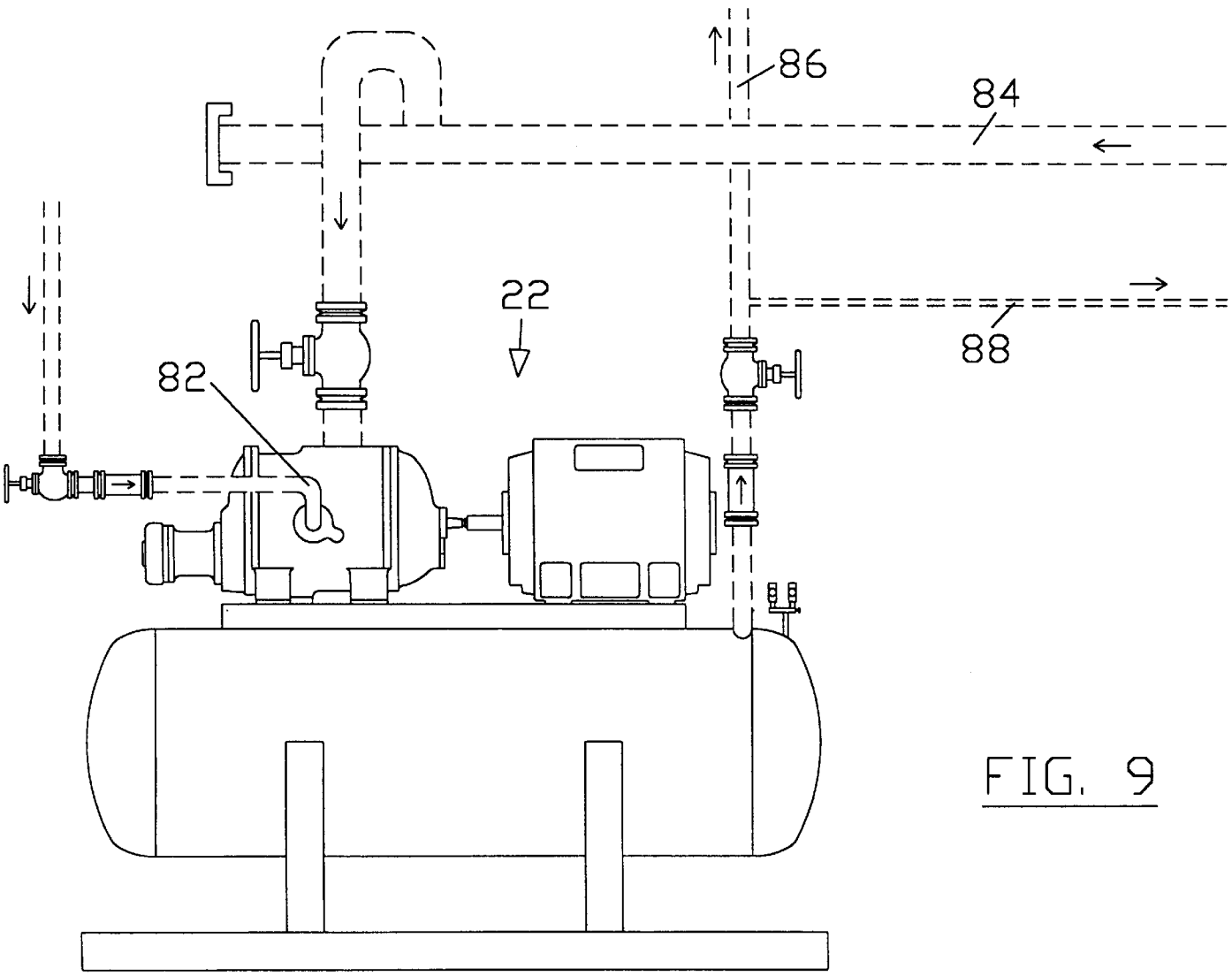
FIG. 9 is an enlarged schematic view of the high stage compressor used in the system of FIG. 2.

Referring now to FIG. 9, the high stage compressor 22 may be of any type, from the standard reciprocating compressor to the screw compressor. Typically, rotary vane compressors are not used on high stage applications, because of the high pressure. The economizer port 82 may be used to control the pressure in receiver 12, however, it is recommended that the dedicated compressor 28, shown in FIGS. 1, 2, and 7 be used to control the pressure of the controlled pressure receiver 12. This gives the plant more accurate control of the pressure. Use of the economizer port 82 can do the work of the dedicated compressor 28, when it is loaded to a high amount. As shown in the drawings, refrigerant gas having a pressure of 25–30 psi from the accumulator 20 is piped under suction via pipe 84 to compressor 22. Compressor 22 will compress the ammonia gas to approximately 110–185 psi and discharge the compressed gas to the condenser via conduit 86 and to the transfer tank via conduit 88.

Figure 10:
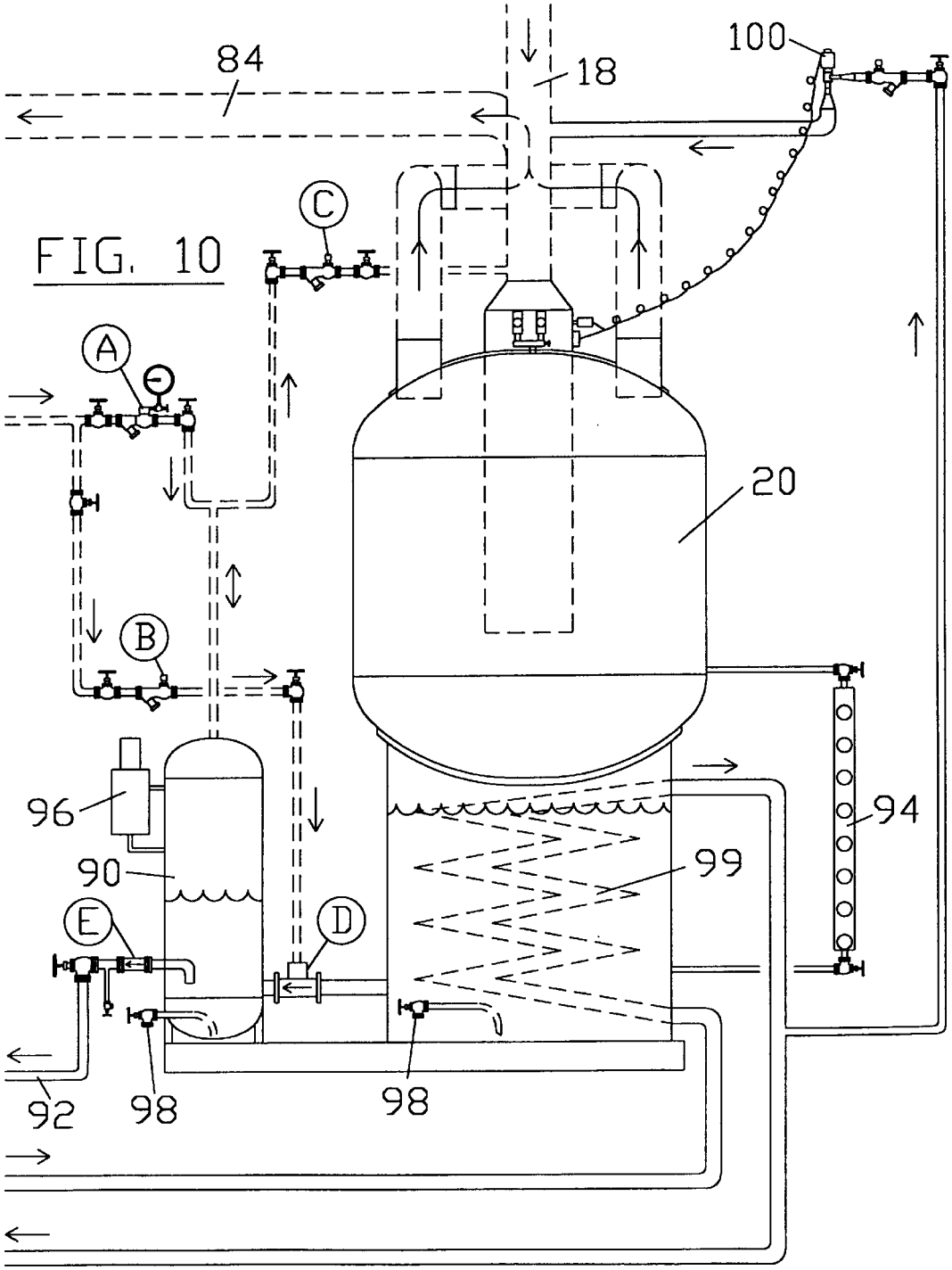
FIG. 10 is an enlarged schematic view of the high temperature accumulator used in the system of FIG. 2.

Referring now to FIG. 10, the accumulator 20 of the single stage refrigeration system is shown in enlarged schematic form. The high stage accumulator 20 utilized in the refrigeration system 10 of the present invention is of a radical design that is not used in standard systems. Suction gas coming back from the plant would enter via line 18, at a pressure of approximately 25–30 psi. Gas traveling to compressor 22 would exit accumulator 20 via pipe 84. While FIG. 10 shows accumulator 20 with dual outlets, dual outlets are not a requirement for the invention. A liquid transfer tank 90 is conventionally mounted adjacent accumulator 20, and serves to transfer any liquid from accumulator 20 to either the receiver 12 via pipe 92 or to a low temperature accumulator (described in more detail hereinbelow). The liquid level in accumulator 20 is monitored by a level control device 94, which may be an electronic level probe, floats, or other equivalent liquid level sensing apparatus. As the liquid level in the accumulator 20 rises, the liquid level will also rise in liquid transfer tank 90.

Liquid transfer tank 90 is to remove any excess liquid from the accumulator 20. The valve process is as follows. Under standard conditions when the transfer tank is not transferring, valve "C" is open, valve A and B are closed. This arrangement allows the transfer tank to be at equilibrium with the accumulator, thus allowing any excess liquid to freely flow from the accumulator 20 to the transfer tank 90. When level device 96 indicates that there is sufficient level to transfer, valve C closes, valve B opens, thus using high pressure gas to close valve D to keep the liquid from transferring back to 20 from 90. Valve A opens, using the high pressure gas to push the liquid in 90 into pipe 92 past check valve E. Once the transfer process is finished, then the valves revert back to their normal positions, and check valve E automatically keeps the liquid in line 92 from flowing back into transfer tank 90.

The liquid level in the transfer tank 90 is monitored by a level control device, such as an electronic probe, float switch 96, or other similar apparatus. Oil drain valves 98 are mounted at the bottom of the liquid transfer tank 90, and the accumulator 20.

An electronic expansion valve 100 is installed upstream of the accumulator along line 18 to monitor the super heated gas entering accumulator 20. This will protect the compressor from overheating due to excessive super heated gas coming back from the plant. If the temperature of the super heated gas becomes too high, the expansion valve 100 injects an amount of liquid ammonia into the gas stream in line 18 to quench the excess heat. Expansion valve 100 also feeds the required refrigerant to immerse subcooling coil 99, and is controlled by level control apparatus 94.

Figure 12:
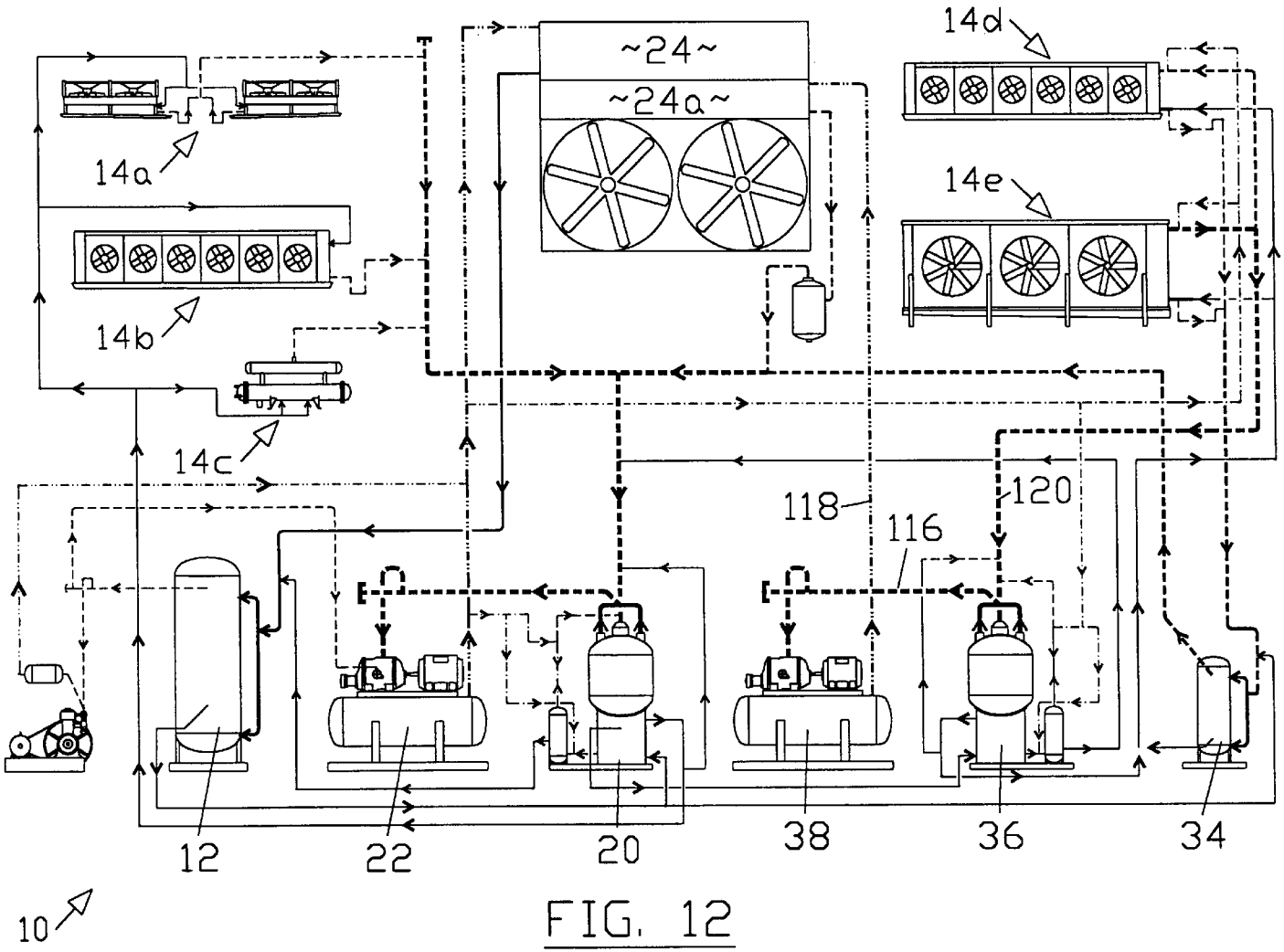
FIG. 12 is a detailed schematic view of a two stage refrigeration system.
Figure 13:
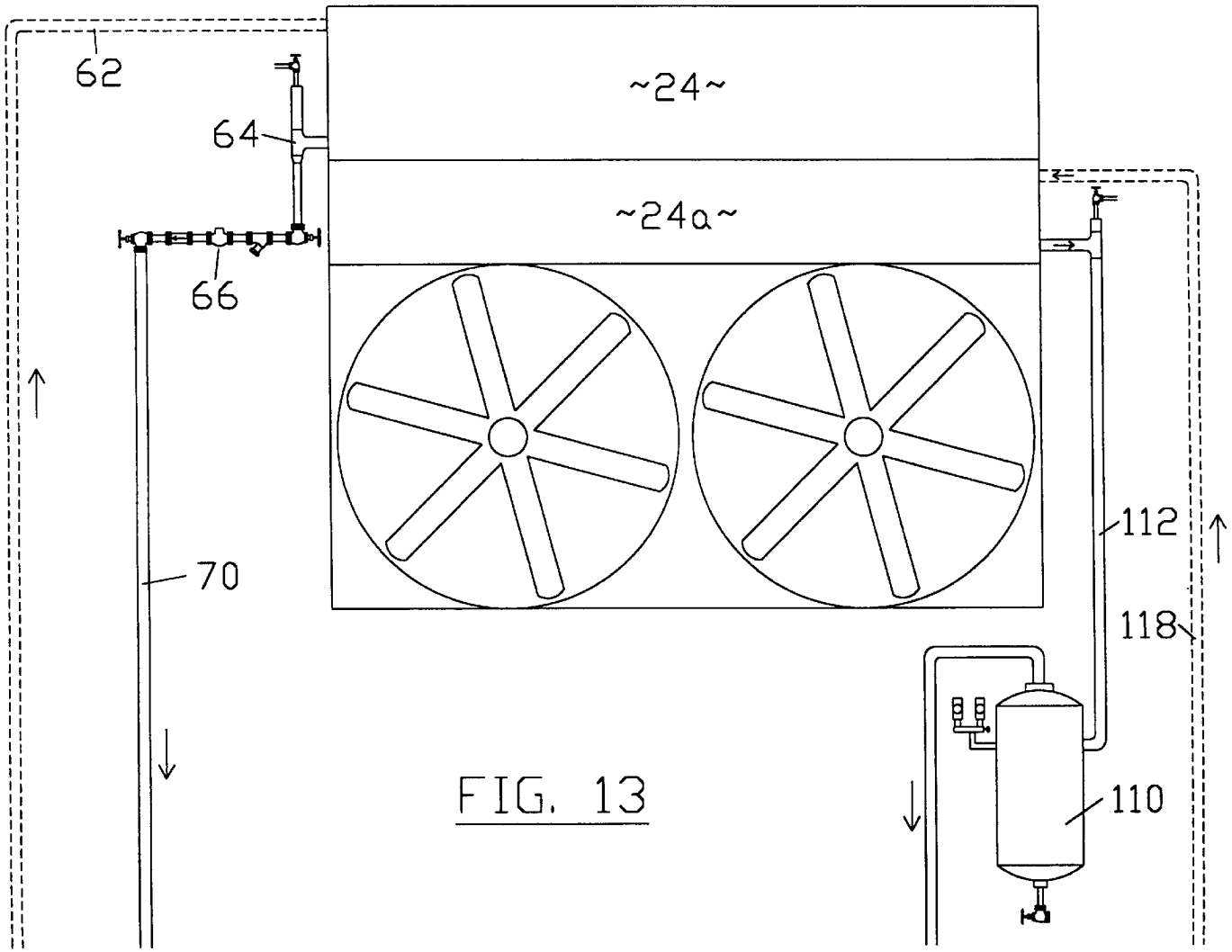
FIG. 13 is an enlarged schematic diagram of a dual coil condenser for the system of FIG. 12.

FIGS. 11 and 12 show a dual stage refrigeration system with a high temperature stage for things such as processing units, cooler units, and chillers, and a low temperature stage for evaporators such as blast freezers where a very low temperature is desired. Beginning with the high stage compressor 22 ammonia gas is pumped from the high stage accumulator 20 to the condenser 24. At the condenser 24, water and air are used to condense the ammonia gas back to a liquid. As shown in FIG. 13, liquid is trapped at each condenser outlet by traps 66. Once the liquid is pushed through the traps, it immediately goes down to controlled pressure receiver 12, as shown in FIG. 12. The pressure of receiver 12 pushes the liquid throughout the plant to the various evaporators 14*a*, 14*b*, and 14*c*. At each evaporator 14*a*, 14*b*, and 14*c*, an electronic expansion valve is utilized to meter the flow of liquid to the exact proportions needed to do maximum cooling, without overfeeding and causing liquid carryover. For extremely low temperature applications, such as a blast freezer where a temperature of 40° F. or lower as desired, the ammonia liquid is pushed from receiver 12 to a low temperature low pressure receiver 34. On a smaller system, a subcooling coil in accumulator 36 would be used, similar to coil 99 in accumulator 20, thereby eliminating receiver 34. Receivers 12 and 34 take the majority of the "flash" out of liquid ammonia, thereby making the evaporators 14*a*, 14*b*, and 14*c* and low temperature evaporators 14*d* and 14*e*, more efficient. "Flash" has been a major problem for ammonia refrigeration systems, and has been known to cause an evaporator coil to loose as much as 10% of its capacity. The refrigeration system 10 of the present invention greatly reduces this problem, and uses the pressure of the receivers to "pump" the liquid. This pressure is typically equal to the pressure a modern liquid ammonia pump would output, so that the efficiency of the "pumping" would not be compromised compared to conventional liquid pumps.

Once the liquid ammonia is evaporated in the various evaporators 14*a*, 14*b*, 14*c*, 14*d* and 14*e*, the ammonia gas is motivated back to the high stage accumulator 20 from evaporators 14*a*, 14*b*, and 14*c*, and to a low stage accumulator 36 from low temperature evaporators 14*d* and 14*e*, respectively. Once in accumulators 20 and 36, the gas is simply suctioned back into the associated compressor 22 and 38, respectively.

On prior art refrigeration systems, liquid pumps or pumper drums are mounted at the accumulators to pump liquid to the rest of the plant. The refrigeration system 10 of the present invention eliminates these pumps or drums. With the pumps removed, the level in the accumulators does not need to be as high as would be needed with pumps. This is due to the elimination of the necessity of maintaining a net positive suction head for the pump to utilize. The elimination of these pumps takes a major maintenance and safety issue out of the operation of a refrigeration system. In addition, removal of such pumps decreases the electrical demand.

Referring now to FIG. 13, condenser 24, in the two-stage version of the invention, includes the standard section 24 which condenses gas from the high stage compressors via inlet pipe 62 and returns the condensed liquid through trap 66 and pipe 70. The second section 24*a* of the condenser takes gas from the low stage compressors 38 (shown in FIG. 12) via line 118 and removes the heat via a desuperheating coil before the gas gets to the high stage accumulator 20. To facilitate the efficient removal of oil, an oil separator 110 is mounted in outlet line 112 from the desuperheating coil of the condenser second section 24*a*.

Figure 14:
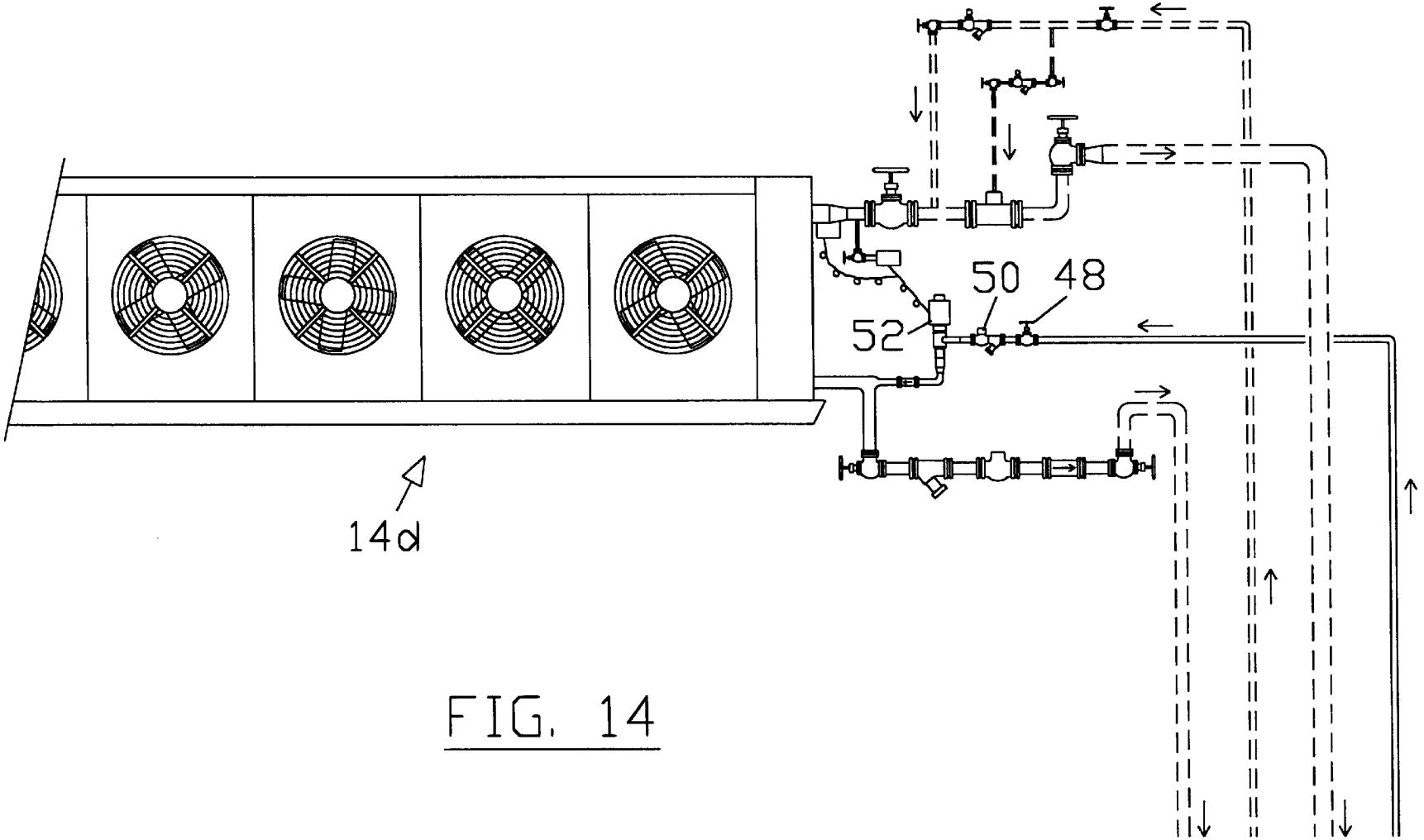
FIG. 14 is an enlarged schematic diagram of a product freezer evaporator for the system of FIG. 12.

FIG. 14 is an enlarged schematic diagram of a product freezer utilizing the low temperature liquid having a pressure of 25–30 psi from the low temperature receiver 34, which passes through a globe valve 48, solenoid 50, and electronic expansion valve 52 before passing to the product freezer 14*d*. Product freezer 14*d* completely evaporates the liquid refrigerant to form ammonia gas which is then suctioned to the low temperature accumulator 36 in a conventional fashion.

Figure 15A:
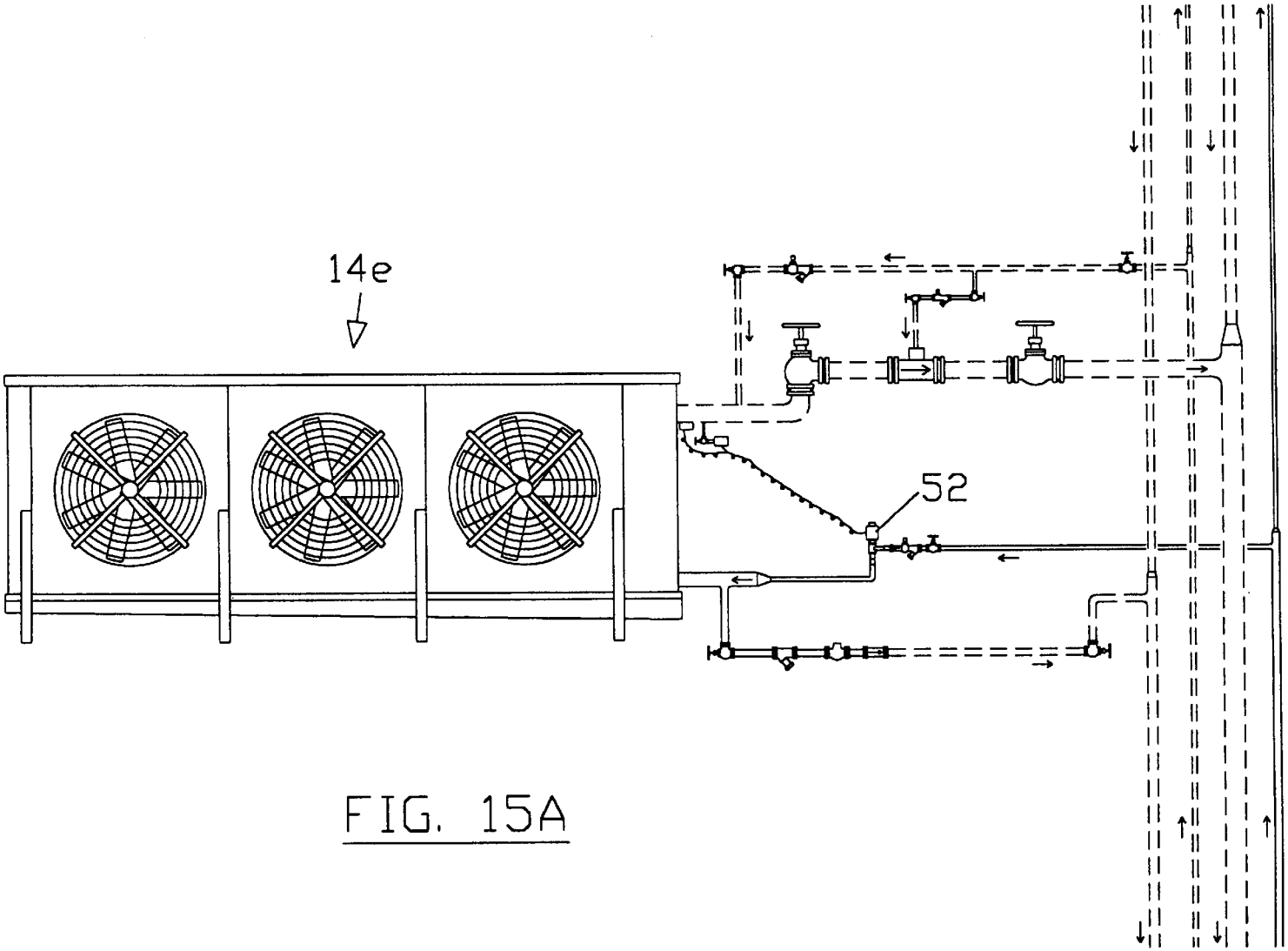
FIG. 15A is an enlarged schematic view of a blast freezer evaporator with an electronic expansion valve for the system of FIG. 12.

FIG. 15A is an enlarged schematic diagram of a blast freezer 14*e* utilizing an electronic expansion valve 52 to assure complete evaporation of the low temperature liquid ammonia, before returning the transformed ammonia gas to the low temperature accumulator.

Figure 15B:
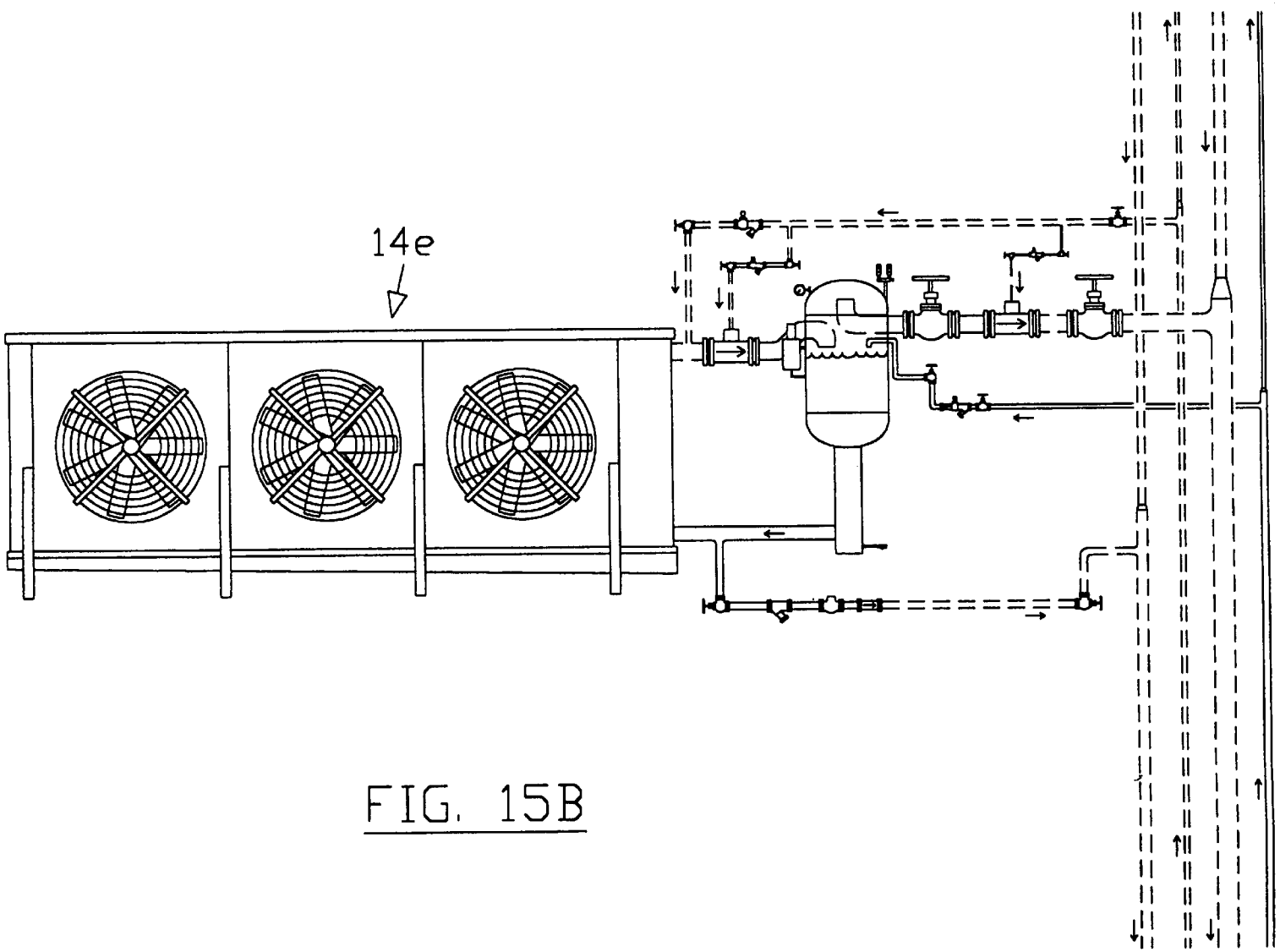
FIG. 15B is an enlarged schematic view of a blast freezer evaporator with a standard flooded configuration for the system of FIG. 12.

FIG. 15B shows a conventional blast freezer utilizing a flooded operation configuration, rather than an electronic expansion valve. The flooded blast freezer can still be run utilizing the refrigeration system of the present invention, because of the dry suction nature of the arrangement.

Figure 16:
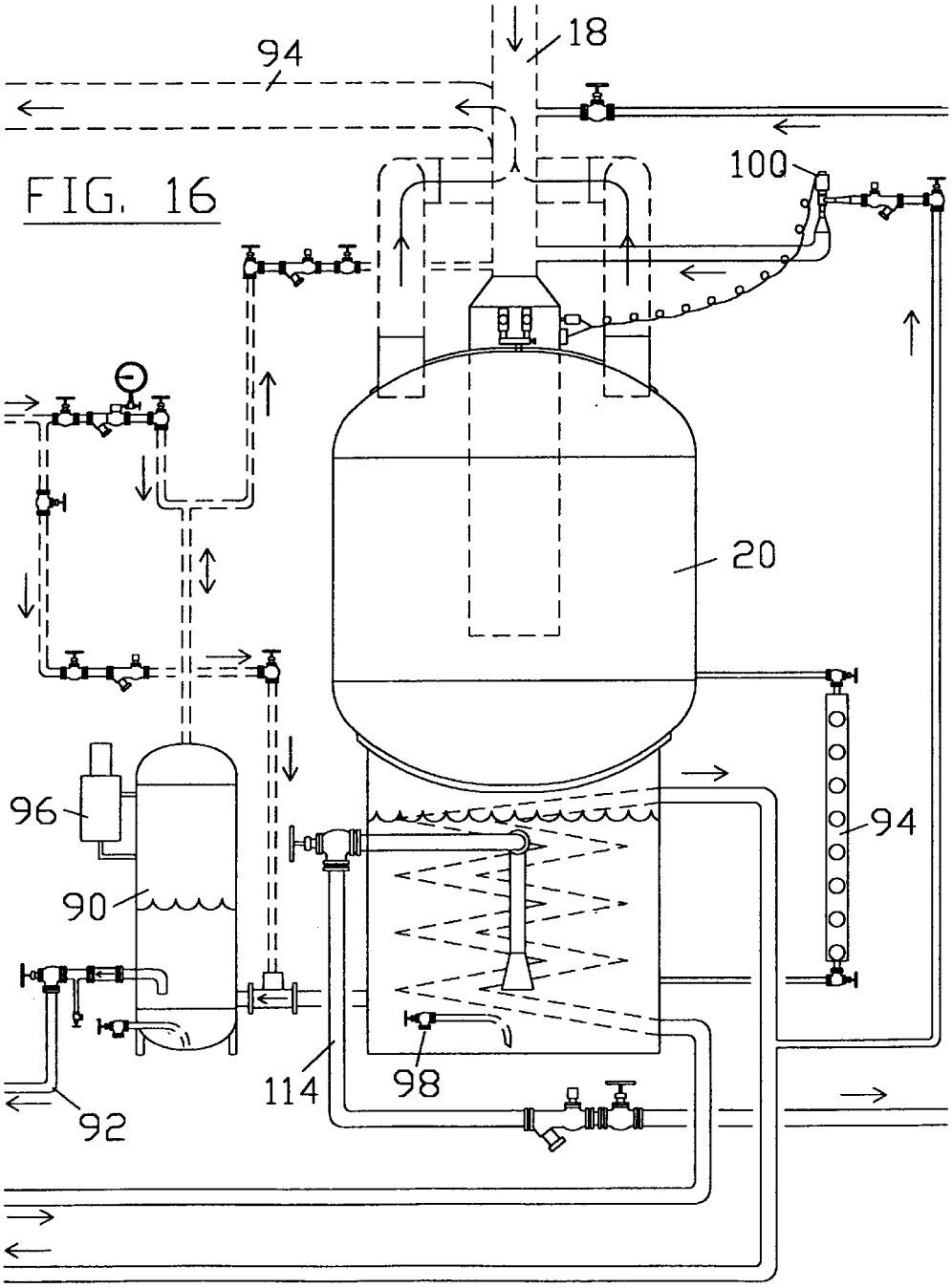
FIG. 16 is an enlarged schematic view of a high temperature accumulator for the system of FIG. 12.

Referring now to FIG. 16, the high stage accumulator 20 of the two stage refrigeration system shown in FIGS. 11 and 12, is virtually identical to the accumulator 20 of the single stage refrigeration system (shown in more detail in FIG. 10), and thus all reference numerals are identical, and the operation of the accumulator will not be explained in detail. The major difference between the high stage accumulator of FIG. 16 and the accumulator of the single stage system of FIG. 10, is the installation of a fluid outlet conduit 114 in the lower end of the accumulator which will supply low temperature fluid to the low stage receiver 34, for further reduction of temperature in the low stage of the two stage refrigeration system of FIGS. 11 and 12.

Figure 17:
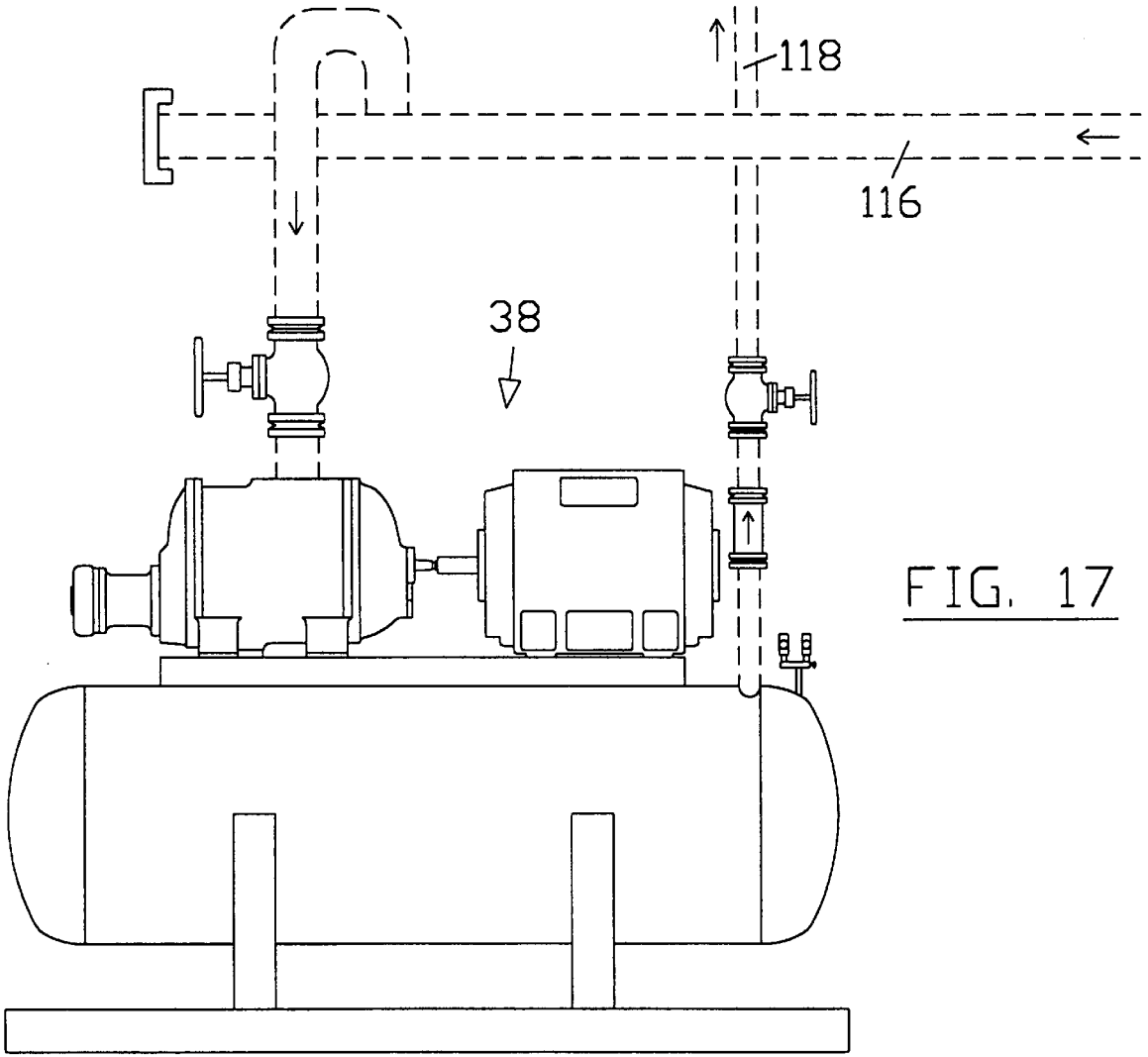
FIG. 17 is an enlarged schematic view of a low stage compressor for the system of FIG. 12.

Referring now to FIG. 17, the low stage compressor 38 is shown in more detail. As with the high stage compressor 22, low stage compressor 38 may be of any type, including rotary, screw, or reciprocating. As shown in the drawings, refrigerant gas having a pressure of 15" Hg–0 psig from the low stage accumulator 36 is piped under suction via pipe 116 to compressor 38. Compressor 38 will compress the gas to approximately 25–30 psi and discharge the compressed gas to the condenser 24 (shown in FIG. 12).

Figure 18:
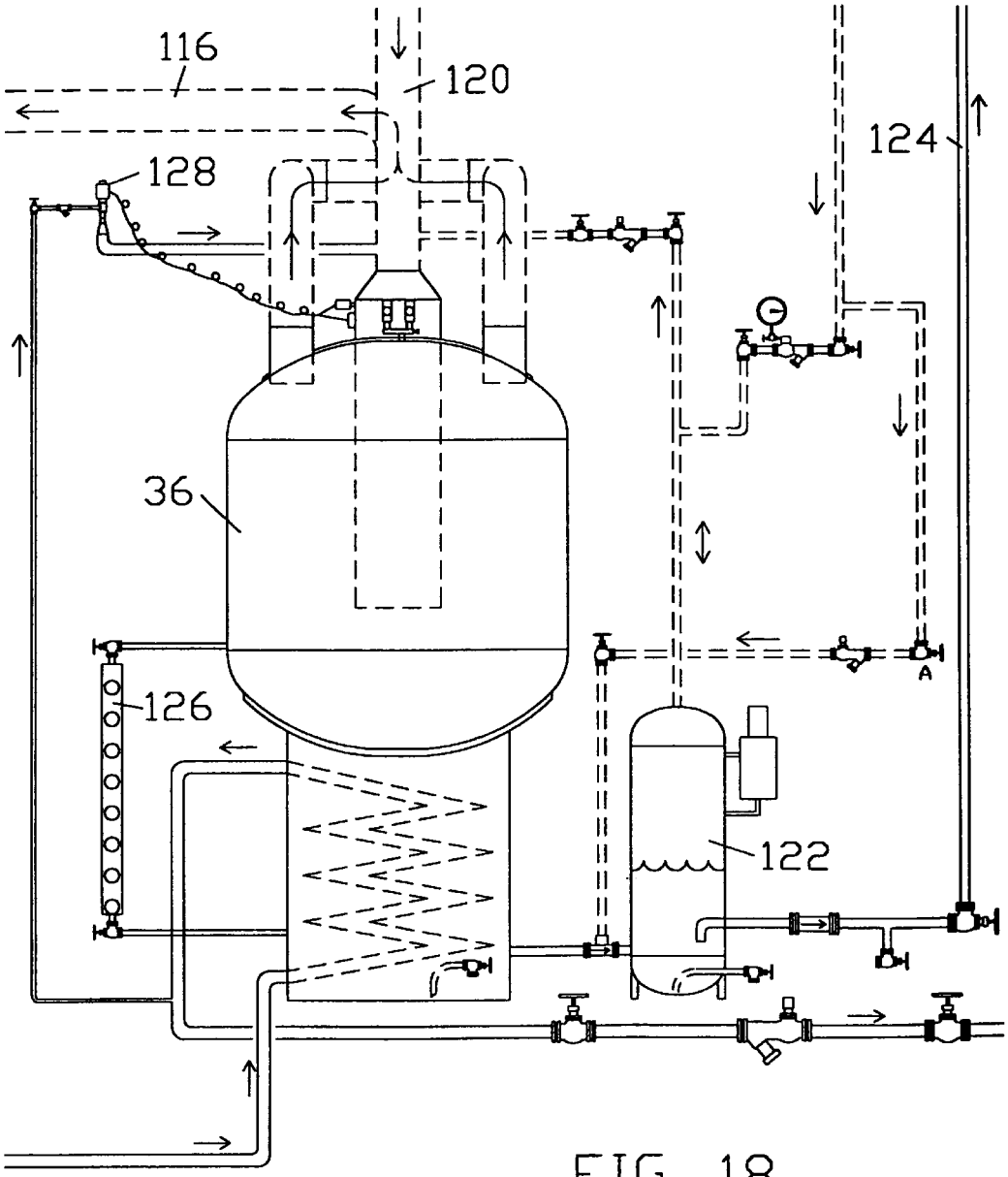
FIG. 18 is an enlarged schematic view of a low temperature accumulator for the system of FIG. 12.

The low stage accumulator, shown in FIG. 18, is of a similar design as the high stage accumulator, explained above and shown in FIG. 16, and the accumulator 20 of the single stage refrigeration system, described in detail with reference to FIG. 10. Suction gas coming back from the plant and various evaporators 14*d* and 14*e* would enter through line 120 at a pressure of approximately 15" Hg–0 psig. Gas traveling to the low stage compressor 38 would exit accumulator 36 via pipe 116. As with the high stage accumulator, a liquid transfer tank 122 is mounted adjacent to accumulator 36, and serves to transfer any liquid from accumulator 36 to either the high stage accumulator 20, via conduit 124. The liquid level in low stage accumulator 36 is monitored by a level control device 126, which may be an electronic level probe, floats, or other equivalent liquid level sensing apparatus. Transfer tank 122 operates in the same fashion as liquid transfer tank 90 of the high stage accumulator, and therefore will not be described in detail herein.

An electronic expansion valve 128 is installed upstream of the low stage accumulator 36 to monitor the superheated gas entering low stage accumulator 36. This is to protect the compressor from overheating due to excessive superheated gas coming back from the plant. If the temperature of the superheated gas becomes too high, the expansion valve 128 injects an amount of liquid ammonia into the gas stream in line 120 to quench the excess heat.

FIGS. 10, 16 and 18 show a coil immersed in liquid in the bottom leg of the accumulator (20 on FIG. 10). This coil is immersed to allow subcooling of the liquid prior to going out to the rest of the plant. The coil on the high stage accumulator subcools the liquid prior to going out to a user on the high stage section of the system. The coil on the low stage accumulator subcools the liquid prior to the liquid going to the users on the low stage section of the system. This aids in the efficiency of the system as these coils remove additional heat form the liquid.

Figure 19:
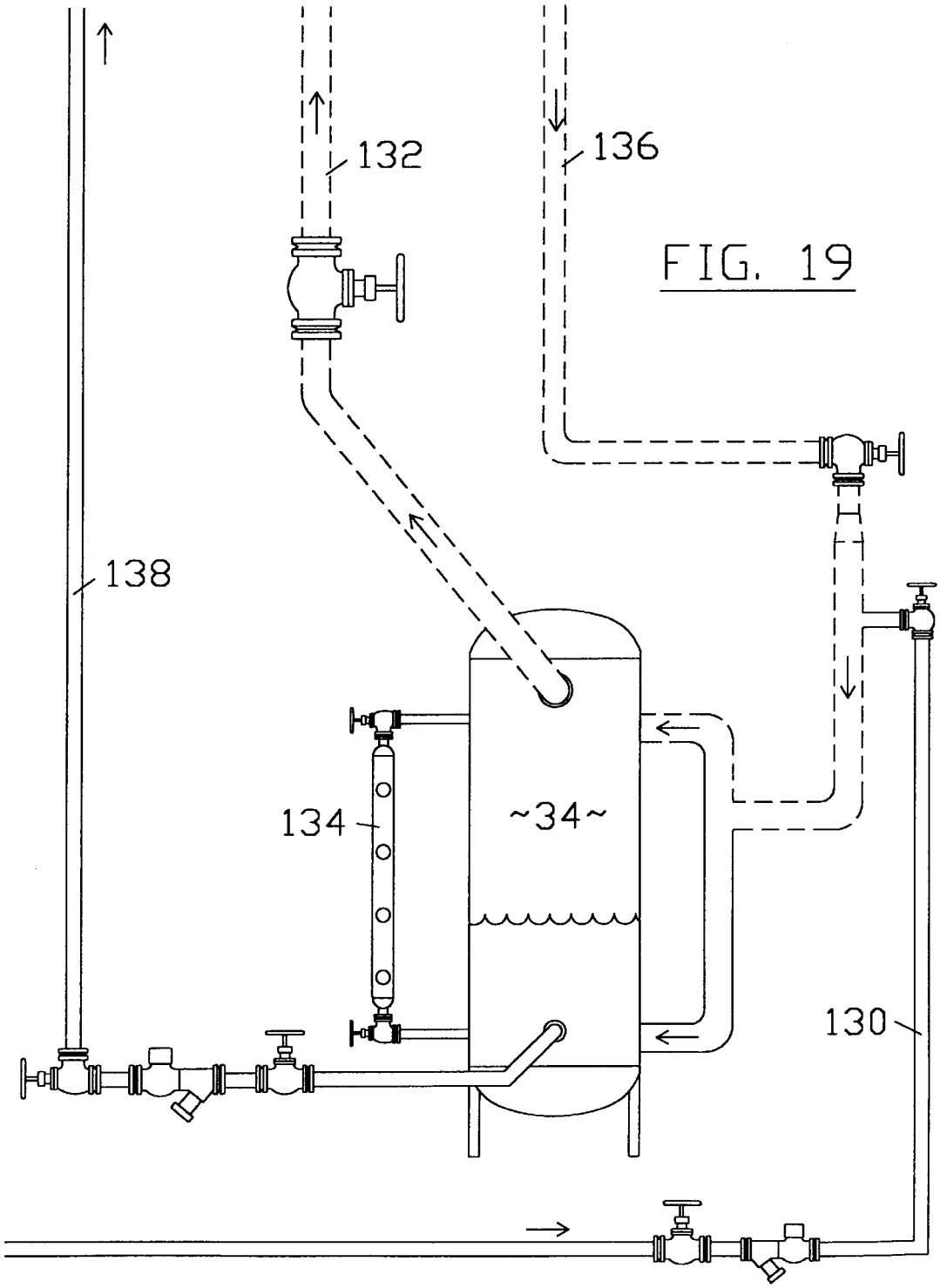
FIG. 19 is an enlarged schematic view of a low temperature controlled pressure receiver for the system of FIG. 12.

Referring now to FIG. 19, the low stage receiver 34 is shown in more detail. The purpose of low stage receiver 34 is to take additional flash gas out of the liquid refrigerant before it is pumped to low temperature evaporates 14*d* and 14*e* (shown in FIG. 12). The liquid level within the tank of low pressure receiver 34 is typically maintained by a liquid line 130 from either the high stage accumulator 20 or the reduced pressure receiver 12 of the high stage. The pressure of this tank is maintained by the suction of the high stage compressor 22 via line 132, although it is possible to maintain this pressure with a pressure regulating device. As with the high stage receiver, the low stage receiver 34 may utilize a pressure regulator valve to aid in maintaining this pressure.

The liquid level in the low stage receiver 34 is monitored by a level control device 134. If the liquid level becomes too low, a liquid is transferred via line 130 into receiver 34. Defrost return may be brought into the low stage receiver 34 via line 136, or it may be directed to the accumulators, as discussed above. Liquid for the low temperature evaporators 14*d* and 14*e* is "pumped" out of low stage receiver 34 using the pressure within receiver 34, through line 138.

Figure 20:
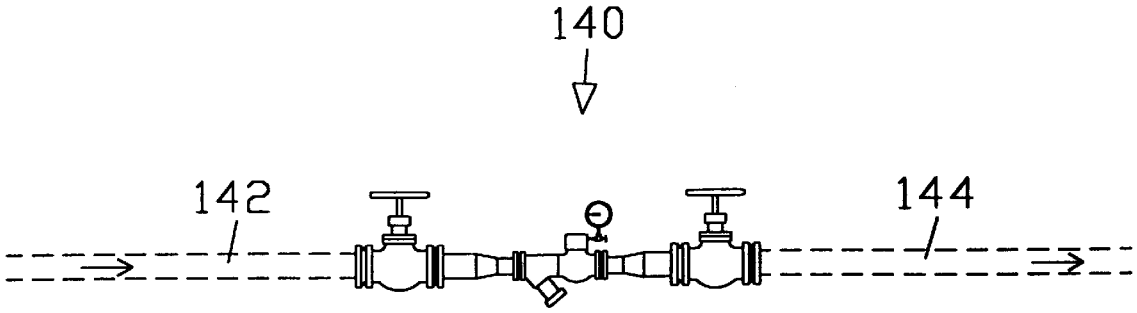
FIG. 20 is an enlarged schematic view of a hot gas pressure regulator for the system of FIG. 12.

Finally, FIG. 20 shows a pressure regulator valve 140 to control defrost pressure to the plant. Typically, discharge from the high stage of the system would enter the pressure regulator via conduit 142 at a pressure of 110–185 psi. Gas would exit pressure regulator 140, via conduit 144, at a pressure of 75–80 psi. Pressure regulator valve 140 is a good feature for improved efficiency and safety for the refrigeration system of the present invention.

Whereas the invention has been shown and described in connection with the preferred embodiment thereof, many modifications, substitutions and additions may be made which are within the intended broad scope of the appended claims.

We claim:

1. A dry suction refrigeration system, comprising:

an evaporator fed with liquid refrigerant and discharging a vapor refrigerant;

an accumulator for accumulating vapor refrigerant discharged from the evaporator;

a compressor receiving vapor refrigerant from the accumulator, for compressing the vapor refrigerant;

a condenser receiving compressed vapor refrigerant from the compressor, for condensing it into liquid refrigerant;

a receiver receiving the liquid refrigerant from the condenser and supplying it to the evaporator;

said evaporator including an electronic expansion valve operable to continuously monitor the evaporation of liquid refrigerant in the evaporator and to continuously adjust the flow of liquid refrigerant to the evaporator, to cause complete vaporization of the liquid refrigerant; and an electronic expansion valve located to monitor vapor refrigerant temperature entering the accumulator and operable to inject liquid refrigerant from the receiver into the vapor refrigerant to selectively lower the temperature thereof.

2. The system of claim 1, wherein vapor refrigerant is moved from the evaporator to the accumulator, compressor and condenser by pressure differential alone.

3. The system of claim 1, further comprising a trap interposed between the condenser and receiver, the trap of a type which allows only liquid to pass therethrough while maintaining a pressure differential across the trap.

4. The system of claim 3, wherein pressure on the upstream side of the trap is regulated by the capacity of the condenser, and wherein pressure on the downstream side of the trap is regulated by the compressor.

5. The system of claim 1, further comprising a second dedicated compressor connected between the receiver and the downstream side of the first compressor, for controlling the pressure within the receiver.

6. The system of claim 5, wherein said second compressor is connected to the receiver for receiving vapor refrigerant within the receiver, and for compressing the vapor refrigerant to control pressure in the receiver.

7. The system of claim 1, wherein liquid refrigerant is moved from the receiver to the evaporators solely by pressure differential between the evaporator and the receiver.

8. The system of claim 1, wherein said refrigerant is ammonia.

9. The system of claim 8, wherein the vapor refrigerant has a pressure of about 25–30 psi from the accumulator to the compressor, wherein the compressed vapor refrigerant has a pressure of about 110–185 psi; from the compressor to the condenser and wherein the liquid refrigerant has a pressure of about 55–60 psi from the condenser to the receiver and thence to the evaporator.

10. The system of claim 1, wherein said accumulator includes:

a vapor refrigerant tank supported on a liquid refrigerant leg, such that any liquid removed from the fluid flow into the accumulator is stored in the liquid leg below the tank;

said tank having an intake conduit in an upper end thereof extending downwardly into the tank at least half way to the lower end of the tank;

said tank having at least one exhaust port in the upper end thereof, for exhausting accumulated vapor refrigerant.

11. The system of claim 10, wherein said tank intake conduit extends approximately three-fourths of the distance from the upper end of the tank to the lower end of the tank.

12. The system of claim 10, further comprising a liquid transfer tank connected to the accumulator leg and operable to transfer liquid from the leg to the receiver upon the liquid level in the leg reaching a predetermined level.

13. The system of claim 1, further comprising a second, low temperature, low pressure stage for a low temperature evaporation, said evaporator, accumulator, compressor, and receiver being hereinafter identified as the high stage evaporator, accumulator, compressor and receiver, said high stage accumulator including a tank having liquid refrigerant collected in a lower end thereof, and vapor refrigerant accumulated in an upper end thereof, and wherein said second low stage includes:

a low stage receiver for receiving low temperature liquid refrigerant from the lower end of the high stage accumulator tank, said low temperature liquid refrigerant having a lower temperature and pressure than the liquid refrigerant in the high stage, and supplying the low temperature liquid refrigerant to a low temperature evaporator;

said low temperature evaporator evaporating the low temperature liquid refrigerant and discharging a low temperature vapor refrigerant;

a low stage accumulator for accumulating low temperature vapor refrigerant discharged from the low stage evaporator;

a low stage compressor receiving low temperature vapor refrigerant from the low stage accumulator, for compressing the low temperature vapor refrigerant;

said condenser including a second section for receiving compressed low temperature vapor refrigerant and cooling the vapor refrigerant and supplying it to the high stage accumulator;

said low temperature evaporator including an electronic expansion valve operable to continuously monitor the evaporation of low temperature vapor refrigerant and to continuously adjust the flow of the low temperature liquid refrigerant to the low temperature evaporator, to cause complete evaporation of the low temperature liquid refrigerant.

14. The system of claim 10, wherein said tank includes two diametrically opposed exhaust ports in the upper end thereof, for splitting the flow of exhausting accumulated vapor refrigerant.

* * * * *